US007931447B2

(12) United States Patent
Levin et al.

(10) Patent No.: US 7,931,447 B2
(45) Date of Patent: Apr. 26, 2011

(54) DRAIN SAFETY AND PUMP CONTROL DEVICE

(75) Inventors: Alan R. Levin, Bermuda Run, NC (US); Gary Ortiz, Clemmons, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 984 days.

(21) Appl. No.: 11/601,588

(22) Filed: Nov. 17, 2006

(65) Prior Publication Data

US 2008/0003114 A1 Jan. 3, 2008

Related U.S. Application Data

(60) Provisional application No. 60/817,473, filed on Jun. 29, 2006.

(51) Int. Cl.
*F04B 49/00* (2006.01)
*G05D 7/00* (2006.01)

(52) U.S. Cl. ..... 417/38; 417/36; 417/306; 700/282

(58) Field of Classification Search ..... 417/306, 417/36, 18, 279, 53; 700/282, 28
See application file for complete search history.

(56) References Cited

U.S. PATENT DOCUMENTS

| | | | |
|---|---|---|---|
| 2,096,595 | A | 10/1937 | Sanford |
| 2,250,021 | A | 7/1941 | Hofer |
| 2,572,263 | A | 10/1951 | Hofer |
| 2,603,234 | A | 7/1952 | Hofer |
| 2,644,400 | A | 7/1953 | Hofer |

(Continued)

FOREIGN PATENT DOCUMENTS

EP 0863278 A2 9/1988

(Continued)

OTHER PUBLICATIONS

Sanderfoot, Alan E., "Too Late, But Not Too Little", Aqua—The Business Magazine for Spa & Pool Professionals, Jul. 1996, vol. 21, No. 7, p. 8.

(Continued)

*Primary Examiner* — Charles G Freay
*Assistant Examiner* — Alexander B Comley
(74) *Attorney, Agent, or Firm* — McCarter & English, LLP

(57) ABSTRACT

A drain protection device and pump controller for pools, spas, fountains and other fluid containment and circulation systems has a vacuum sensor for sensing a level of vacuum present in the suction conduit leading to the pump(s). The vacuum level is monitored by a computer that controls a vent valve that can vent to atmosphere to reduce the vacuum exerted at a drain. In applications with a flooded pump, e.g., above-ground pools, the vent valve may control the discharge of an accumulator that injects fluid pressurized by the return line into the suction conduit to reduce the vacuum therein. The computer also controls the pump(s) present in the circulation system, viz., turns them off to relieve vacuum when a drain is occluded and also runs them at the selected speed based upon a schedule. The vacuum criteria for vacuum reduction may include progressively sensitive values, some of which may be empirically based. Vacuum criteria may be maintained based upon the operational state of the circulation system, e.g., priming, stabilized running or cleaning. Low vacuum limits protect the pump(s) from dry running. A clogged vacuum conduit leading to the vacuum sensor is sensed based upon the presence of vacuum levels that are atypically constant and error processing invoked.

30 Claims, 18 Drawing Sheets

U.S. PATENT DOCUMENTS 2,680,168 A 6/1954 Murphy
2,767,277 A 10/1956 Wirth
2,889,779 A 6/1959 Hofer
3,145,724 A 8/1964 Pelzer
3,195,556 A 7/1965 Norstrud et al.
3,252,479 A 5/1966 Klock, Jr.
3,781,925 A 1/1974 Curtis et al.
3,957,395 A 5/1976 Ensign
3,966,358 A 6/1976 Heimes et al.
4,107,492 A 8/1978 Moon, Jr. et al.
4,115,878 A 9/1978 Johnson et al.
4,116,577 A 9/1978 Lauck
4,180,374 A 12/1979 Bristow
4,278,403 A 7/1981 Shafer
4,322,297 A 3/1982 Bajka
4,329,120 A 5/1982 Walters
4,402,094 A 9/1983 Sanders
4,424,438 A 1/1984 Antelman et al.
4,444,546 A 4/1984 Pazemenas
4,456,432 A 6/1984 Mannino
4,505,643 A 3/1985 Millis et al.
4,525,125 A 6/1985 Matsumtot et al.
4,556,807 A 12/1985 Yamada et al.
4,558,238 A 12/1985 Yamada et al.
4,602,391 A 7/1986 Sheperd
4,616,215 A 10/1986 Maddalena
4,620,835 A 11/1986 Belll
4,659,235 A 4/1987 Gilmore, Jr. et al.
4,663,613 A 5/1987 Raleigh et al.
4,676,914 A 6/1987 Mills et al.
4,686,439 A 8/1987 Cunningham et al.
4,724,074 A 2/1988 Schaupp
4,742,456 A 5/1988 Kamena
4,749,377 A 6/1988 Mendizabal et al.
4,781,536 A 11/1988 Hicks
4,797,958 A 1/1989 Guzzini
4,799,048 A 1/1989 Goshima et al.
4,861,231 A 8/1989 Howard
4,867,645 A 9/1989 Foster
4,913,625 A 4/1990 Gerlowski
5,006,044 A 4/1991 Walker, Sr. et al.
5,064,347 A 11/1991 La Valley, Sr.
5,076,761 A 12/1991 Krohn et al.
5,076,763 A 12/1991 Anastos et al.
5,120,198 A 6/1992 Clark
5,146,943 A 9/1992 Bert
5,167,041 A 12/1992 Burkitt, III
5,190,442 A 3/1993 Jorritsma
5,221,189 A 6/1993 Henningsen
5,240,379 A 8/1993 Takashi et al.
5,244,351 A 9/1993 Arnette
5,259,733 A 11/1993 Gigliotti et al.
5,278,455 A 1/1994 Hamos
5,347,664 A 9/1994 Hamza et al.
5,361,215 A 11/1994 Tompkins et al.
5,365,964 A 11/1994 Sorensen
5,410,150 A 4/1995 Teron et al.
5,415,221 A * 5/1995 Zakryk ..... 165/283
5,422,014 A 6/1995 Allen et al.
5,464,327 A 11/1995 Horwitz
5,475,619 A 12/1995 Sugano et al.
5,499,406 A 3/1996 Chalberg et al.
5,545,012 A 8/1996 Anastos et al.
5,550,753 A 8/1996 Tompkins et al.
5,559,720 A * 9/1996 Tompkins et al. ..... 700/300
5,570,481 A 11/1996 Mathis et al.
5,580,221 A 12/1996 Triezenberg
5,582,509 A * 12/1996 Quilty et al. ..... 417/77
5,585,025 A 12/1996 Idland
5,601,413 A 2/1997 Langley et al.
5,602,670 A 2/1997 Kegan
5,616,239 A 4/1997 Wendell et al.
5,658,131 A 8/1997 Aoki et al.
5,672,049 A 9/1997 Ciurlo
5,672,050 A 9/1997 Webber et al.
5,682,624 A * 11/1997 Ciochetti ..... 4/509
5,682,684 A 11/1997 Wentzlaff et al.
5,690,476 A 11/1997 Miller
5,707,211 A 1/1998 Kochan, Sr.
5,725,359 A 3/1998 Dongo et al.
5,730,861 A 3/1998 Sterghos et al.
5,759,414 A 6/1998 Wilkes et al.
5,772,403 A 6/1998 Allison et al.
5,795,328 A 8/1998 Barnitz et al.
5,796,184 A 8/1998 Kuhnl et al.
5,809,796 A 9/1998 Zakryk
5,822,807 A 10/1998 Gallagher et al.
5,846,056 A 12/1998 Dhindsa et al.
5,865,601 A 2/1999 Miller
5,894,609 A 4/1999 Barnett
5,895,565 A 4/1999 Steininger et al.
5,898,958 A 5/1999 Hall
5,947,689 A 9/1999 Schick
5,947,700 A * 9/1999 McKain et al. ..... 417/306
5,971,712 A 10/1999 Kann
5,991,939 A 11/1999 Mulvey
6,003,165 A 12/1999 Loyd
6,038,712 A 3/2000 Chalberg et al.
6,039,543 A 3/2000 Littleton
6,041,801 A 3/2000 Gray et al.
6,045,331 A 4/2000 Gehm
6,053,193 A 4/2000 Baker et al.
6,059,536 A 5/2000 Stingl
6,065,941 A 5/2000 Gray
6,098,648 A 8/2000 Bertoia
6,098,654 A 8/2000 Cohen et al.
6,099,264 A 8/2000 Du
6,123,510 A 9/2000 Greer et al.
6,171,073 B1 * 1/2001 McKain et al. ..... 417/306
6,186,167 B1 2/2001 Grumstrup et al.
6,227,808 B1 5/2001 McDonough
6,251,285 B1 6/2001 Ciochetti
6,253,227 B1 6/2001 Tompkins et al.
6,253,391 B1 7/2001 Watanabe et al.
6,261,065 B1 * 7/2001 Nayak et al. ..... 417/53
6,269,493 B2 8/2001 Sorensen
6,273,686 B1 8/2001 Kroell et al.
6,295,661 B1 10/2001 Bromley
6,295,662 B1 10/2001 Idland et al.
6,341,387 B1 * 1/2002 Zars ..... 4/504
6,342,841 B1 1/2002 Stingl
6,374,854 B1 4/2002 Acosta
6,390,781 B1 5/2002 McDonough
6,461,113 B1 10/2002 Gaudet et al.
6,468,052 B2 * 10/2002 McKain et al. ..... 417/306
6,497,554 B2 12/2002 Yang et al.
6,547,529 B2 4/2003 Gross
6,568,416 B2 5/2003 Tucker et al.
6,590,188 B2 7/2003 Cline et al.
6,591,863 B2 7/2003 Ruschell et al.
6,623,245 B2 9/2003 Meza et al.
6,657,546 B2 12/2003 Navarro et al.
6,659,980 B2 12/2003 Moberg et al.
6,663,349 B1 12/2003 Discenzo et al.
6,676,382 B2 1/2004 Leighton et al.
6,676,831 B2 * 1/2004 Wolfe ..... 210/85
6,687,923 B2 * 2/2004 Dick et al. ..... 4/504
6,709,241 B2 3/2004 Sabini et al.
6,747,367 B2 * 6/2004 Cline et al. ..... 307/11
6,779,205 B2 * 8/2004 Mulvey et al. ..... 4/509
6,783,328 B2 8/2004 Lucke et al.
6,796,776 B2 9/2004 Jolley et al.
6,810,915 B2 11/2004 Umetsu et al.
6,939,109 B2 9/2005 Takashi et al.
6,957,742 B1 10/2005 Pillart
6,976,052 B2 * 12/2005 Tompkins et al. ..... 709/201
7,167,087 B2 1/2007 Corrington et al.
7,292,898 B2 11/2007 Clark et al.
2001/0041139 A1 11/2001 Sabini et al.
2002/0070611 A1 6/2002 Cline et al.
2002/0089236 A1 7/2002 Cline et al.
2002/0094277 A1 7/2002 Gaudet et al.
2002/0104158 A1 8/2002 Dick et al.
2002/0141877 A1 10/2002 Jayanth et al.
2002/0150476 A1 10/2002 Lucke et al.
2003/0006891 A1 1/2003 Wild et al.
2003/0049134 A1 3/2003 Leighton et al.

| | | | | |
|---|---|---|---|---|
| 2003/0106147 | A1* | 6/2003 | Cohen et al. | 4/504 |
| 2004/0219025 | A1 | 11/2004 | Garcia-Ortiz | |
| 2005/0123408 | A1* | 6/2005 | Koehl | 417/53 |
| 2005/0191184 | A1 | 9/2005 | Vinson et al. | |
| 2005/0193485 | A1* | 9/2005 | Wolfe | 4/504 |
| 2005/0260079 | A1 | 11/2005 | Allen | |
| 2006/0045750 | A1 | 3/2006 | Stiles | |
| 2006/0045751 | A1 | 3/2006 | Beckman et al. | |
| 2006/0090255 | A1* | 5/2006 | Cohen | 4/509 |
| 2006/0112480 | A1 | 6/2006 | Sisk | |
| 2006/0127227 | A1 | 6/2006 | Mehlhorn et al. | |
| 2007/0114162 | A1 | 5/2007 | Stiles et al. | |
| 2007/0154319 | A1 | 7/2007 | Stiles, Jr. et al. | |
| 2007/0154320 | A1 | 7/2007 | Stiles, Jr. et al. | |
| 2007/0154321 | A1 | 7/2007 | Stiles, Jr. et al. | |
| 2007/0154322 | A1 | 7/2007 | Stiles, Jr. et al. | |
| 2007/0154323 | A1 | 7/2007 | Stiles, Jr. et al. | |
| 2007/0163929 | A1 | 7/2007 | Stiles, Jr. et al. | |
| 2007/0183902 | A1 | 8/2007 | Stiles, Jr. et al. | |

FOREIGN PATENT DOCUMENTS

| | | |
|---|---|---|
| WO | WO 92/13195 | 8/1992 |
| WO | WO 98/36339 | 8/1998 |
| WO | WO 98/59174 | 12/1998 |

OTHER PUBLICATIONS

Pollock, Elissa Sard, "Unrecognized Peril? The Industry Responds to Spa and Pool Drain-Related Drownings", Aqua—The Business Magazine for Spa & Pool Professionals, Jul. 1996, pp. 63-64.

"Important Points to Know About CalSpas", brochure, pp. 1-11.

"Teel Vacuum Switch", Teel brochure, 1995, W.W. Granger, Inc., pp. 1-4.

"Rotary Gear Pumps and Vacuum-On Switch", Teel brochure, p. 1.

Levin, Alan P, P.E., "Design and Development of a Safety Vacuum Release System", Proceedings of the 2007 ASME International Mechanical Engineering Congress and Exposition, Nov. 11-15, 2007, Seattle, Washington, pp. 1-8.

Brochure from A.O. Smith Electrical Products Company, Tipp City, Ohio, featuring eMod Motors (2 pgs.), and eMod Load Sensing Module Specification and Instruction Guide (24 pgs.), 2006.

Webpage from www.pentairpool.com comparing the IntelliFlo Pump and the IntelliFlo 4×160 Pump (1 pg.), and brochure for Pentair Pool Products for IntelliFlo 4×160 Pump (4 pgs.), 2006.

* cited by examiner

| | START | STABILIZE | RUN HIGH | RUN LOW | CLEAN |
|---|---|---|---|---|---|
| $T_1$ | $V_1$ | $V_3$ | $V_5$ | $V_7$ | $V_9$ |
| $T_2$ | $V_2$ | $V_4$ | $V_6$ | $V_8$ | $V_{10}$ |
| ⋮ | | | | | |
| $T_z + \infty$ | $V_z$ | $V_{z+1}$ | $V_{z+2}$ | $V_{z+3}$ | $V_{z+4}$ |

↓

| | START | STABILIZE | RUN HIGH | RUN LOW | CLEAN |
|---|---|---|---|---|---|
| $T_1$ | $R_1$ | $R_3$ | $R_5$ | $R_7$ | $R_9$ |
| $T_2$ | $R_2$ | $R_4$ | $R_6$ | $R_8$ | $R_{10}$ |
| ⋮ | | | | | |
| $T_z + \infty$ | $R_z$ | $R_{z+1}$ | $R_{z+2}$ | $R_{z+3}$ | $R_{z+4}$ |

FIG. 9

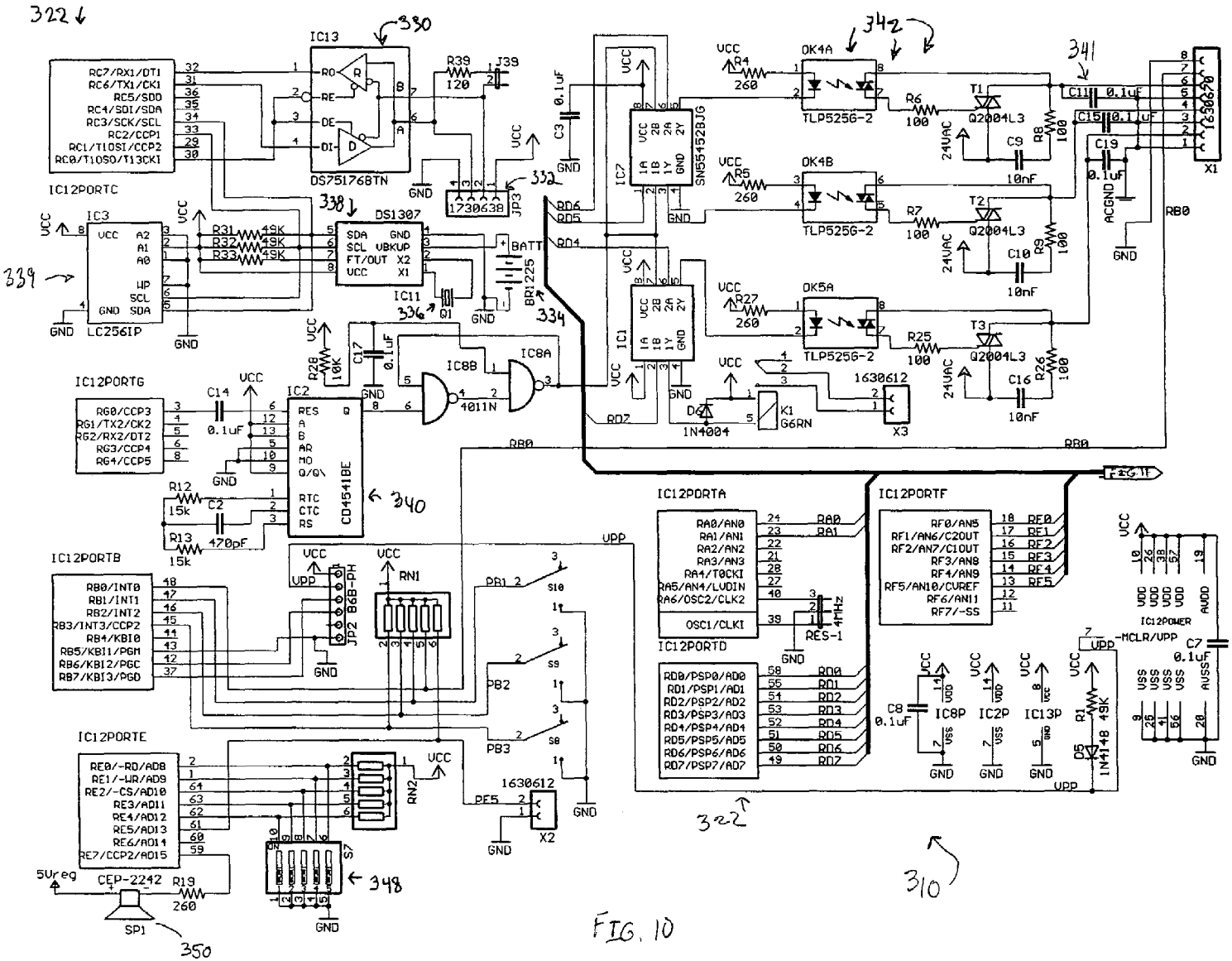
IC12PORTA
IC12PORTB
IC12PORTC
IC12PORTD
IC12PORTE
IC12PORTF
IC12PORTG
IC12POWER
TLP5256-2
SN55452BJG
DS1307
DS75176BTN
CD4541BE
LC2561P
CEP-2242
1N4004
4011N
1N4148
G6RN
5Vreg
VCC
GND
VDD
VPP
VSS
AGND
AVDD
AVSS
-MCLR/VPP
24VAC
10nF
0.1uF
470pF
10K
15k
260
100
120
4TH2
RES-1
BATT
BR1225
SP1
X1
X2
X3
K1
D2
D3
IC1
IC2
IC3
IC7
IC8A
IC8B
IC11
IC13
IC2P
IC3P
IC8P
RN1
RN2
JP2
JP3
S1
T1
T2
T3
R1
R4
R5
R6
R7
R8
R9
R12
R13
R19
R25
R26
R27
R28
R31
R32
R33
R39
C1
C2
C3
C7
C8
C9
C10
C11
C14
C15
C16
C17
C19
C39
PB1
PB2
PB3
PF5
RB0
RA0
RD6
RD5
RD4
RD7
RF6
RF7
RA1
RD1
RD2
RD3
RD0
RE0
RE1
RE2
RE3
RE4
RE5
RE6
RE7
RF0
RF1
RF2
RF3
RF4
RF5
RG0
RG1
RG2
RG3
RG4
RC0
RC1
RC2
RC3
RC4
RC5
RC6
RC7
RB0
RB1
RB2
RB3
RB4
RB5
RB6
RB7
RA2
RA3
RA4
RA5
RA6
RA7
RB6
RB7
RB5
RB4
RB3
RB2
RB1
RB0
RC7
RC6
RC5
RC4
RC3
RC2
RC1
RC0
RE0
RE1
RE2
RE3
RE4
RE5
RE6
RE7
RG0
RG1
RG2
RG3
RG4
RF0
RF1
RF2
RF3
RF4
RF5
RF6
RF7
RA0
RA1
RA2
RA3
RA4
RA5
RA6
RA7
RD0
RD1
RD2
RD3
RD4
RD5
RD6
RD7
RC0
RC1
RC2
RC3
RC4
RC5
RC6
RC7
RB0
RB1
RB2
RB3
RB4
RB5
RB6
RB7
RA0
RA1
RA2
RA3
RA4
RA5
RA6
RA7
RD0
RD1
RD2
RD3
RD4
RD5
RD6
RD7
RE0
RE1
RE2
RE3
RE4
RE5
RE6
RE7
RF0
RF1
RF2
RF3
RF4
RF5
RF6
RF7
RG0
RG1
RG2
RG3
RG4

DRAIN SAFETY AND PUMP CONTROL DEVICE

CROSS-REFERENCE TO RELATED APPLICATION

This application claims the benefit of U.S. Provisional Patent Application No. 60/817,473, filed on Jun. 29, 2006, the disclosure of which is incorporated herein by reference in its entirety.

FIELD OF THE INVENTION

The present invention relates to apparatus and methods for preventing persons, animals or things from being injured by the suction exerted on them by water flowing into a drain, in particular that associated with a fluid circulation system in a bathing receptacle such as a swimming pool or spa. Besides its safety function in preventing injury through drain suction acting on a person or thing, the present invention also controls and prevents damage to water circulation devices, such as pumps, and may be used to control timed operation of water circulation devices.

BACKGROUND OF THE INVENTION

Various apparatus have been proposed for preventing injury due to drains in fluid-containing vessels, such as pools and spas, including those which sense a pressure change in the conduit extending from the drain to the pump that draws water from the drain and through the conduit. In response to pressure changes indicating an obstruction of the drain, prior art devices exist which reduce vacuum present in the drain-to-pump conduit by, e.g., turning the pump off and/or opening the conduit to the atmosphere. Notwithstanding, there is a need for improved drain safety protection devices that are operational for different types of drain installations, e.g., those on above-ground and below-ground pools and spas, as well as protection devices which do not interfere with the normal operation of fluid circulation systems as are typically encountered in pools and spas, e.g., during the normal cycling of filter/pump systems on and off, during the establishment of prime condition and during speed changes for pumps. Further, due to laws pertaining to the running of pumps at higher and lower rates of speed to increase economical operation and diminish the use of electricity, it is desirable to have a drain safety protection device that is capable of maintaining safety through speed changes.

SUMMARY

The limitations of prior art drain safety and pump control devices and methods are addressed by the present invention, which includes a controller system for a fluid containment and circulation system having a fluid receptacle with a fluid outlet through which fluid exits the receptacle, a fluid inlet for returning fluid to the receptacle, a pump that moves the fluid from the fluid outlet to the fluid inlet, a suction conduit providing fluid communication between the fluid outlet and the pump and a return conduit providing fluid communication between the pump and the fluid inlet. The controller system has a vacuum sensor for sensing a level of vacuum present in the suction conduit and producing a corresponding output. A vent valve in the controller system has at least two positions, a first position which fluidly connects the suction conduit to matter outside the suction conduit and a second position which isolates the suction conduit from matter outside the suction conduit. A computer receives the output of the vacuum sensor and has a program that compares the vacuum sensor output to at least one predetermined vacuum criteria. Based upon the comparison, the computer selectively generates control outputs to the vent valve to determine the position of the vent valve and to the pump to control the operation of the pump, based upon the vacuum sensor output.

In one embodiment of the present invention, the control system features a pressure storage device that may be used to inject pressurized fluid through the vent valve when it is in the first position.

BRIEF DESCRIPTION OF THE FIGURES

FIG. 9 is a diagram of data structures for storing selected vacuum level and vacuum range data for various fluid circulation functions and at various times.

FIGS. 10 and 11 are circuit diagrams of a controller in accordance with an exemplary embodiment of the present invention.

FIG. 13 is a schematic diagram of a drain safety and pump control apparatus in accordance with a fourth embodiment of the present invention as used with an above-grade fluid containment vessel and fluid circulation system with.

DETAILED DESCRIPTION OF THE INVENTION

Figure 1:
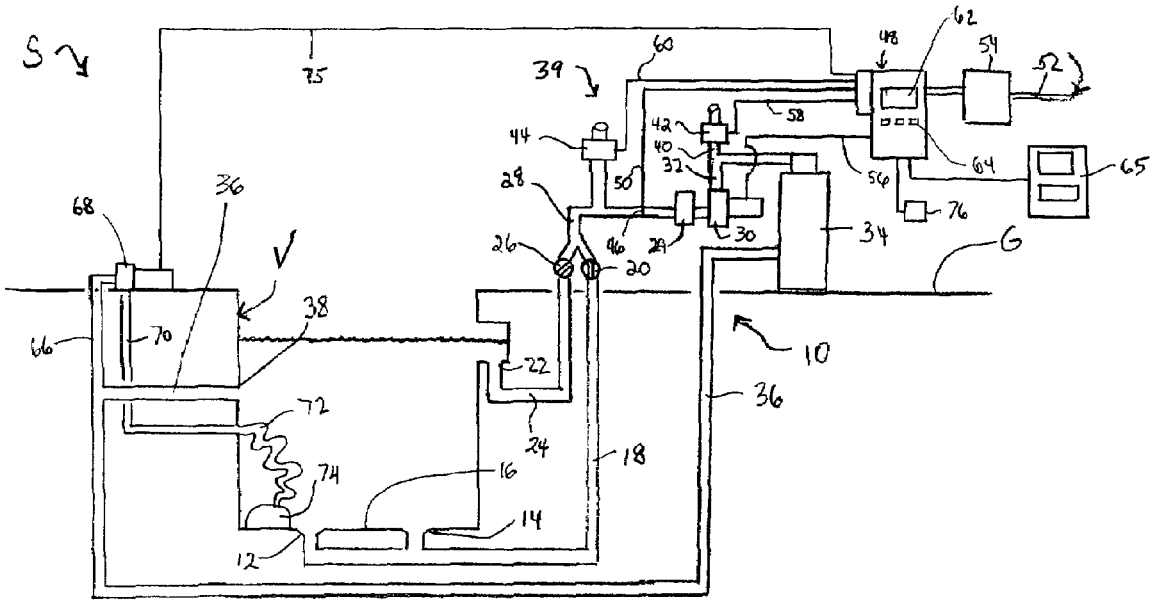
FIG. 1 is a schematic diagram of a below-grade fluid containment vessel and fluid circulation system with drain safety and pump control apparatus in accordance with a first embodiment of the present invention.

FIG. 1 shows a pool/spa system S with a fluid containment vessel V, such as a pool or spa. The containment vessel V is below ground level G as would be common for in-ground pools and spas. The pool/spa system S has a fluid circulation system 10 including one or a plurality of drains 12, 14 at the bottom 16 thereof which communicate with a drain conduit 18 that extends to a valve 20. Alternatively, for smaller pools, a single drain may be used. An upper level drain 22, such as a skimmer, communicates with a corresponding drain conduit 24 that terminates at valve 26. The outlets of the valves 20 and 26 are plumbed to a common suction conduit 28 extending from the valves 20, 26 to a strainer basket 29. The strainer basket 29 discharges into the inlet of a pump 30. The pump 30 discharges into outlet conduit 32 which extends to the inlet of a filter 34. The filter 34 discharges into return conduit 36 which discharges filtered water into the vessel V via a return outlet 38. A vacuum release system 39 is provided to release/reduce vacuum present in the fluid circulation system 10 in response to anomalies such as drain occlusion. More particularly, the outlet conduit 32 has a branch 40 which extends to a vent valve 42. The vent valve 42 is a solenoid valve that is electrically operated to transition between opened and closed positions, opening the branch 40 to the atmosphere. Alternatively, the vent valve may be actuated by vacuum and/or by pressurized gas (e.g., pneumatic) or fluid (hydraulic). An alternative and/or redundant vent valve 44 may be provided to control venting of atmosphere into suction conduit 28. A vacuum sensor 46 is inserted into the suction conduit 28, the vacuum signal of which is transmitted to a controller 48 via line 50. The sensor 46 may be of the solid-state piezoelectric crystal or diaphragm type having an electrical output in the form of a change in resistance to electrical current or an output in volts or millivolts. This type of vacuum sensor 46 can be installed in the suction conduit 28 by means of a threaded fitting or a saddle fitting. Alternatively, a vacuum line extending from a vacuum transducer (not shown) positioned on or proximate to the controller 48 and extending to the suction conduit 28 may be employed. If a vacuum line is employed, kinking of the line must be prevented and the distance between the vacuum conduit 28 and the transducer must not exceed that which would permit an accurate vacuum signal from being conducted along its length. In the situation where a vacuum line extends from the suction conduit 28 to a vacuum transducer at the controller 48, the vacuum line may communicate with the vent valve 42, such that when the vent valve 42 is opened to the atmosphere, the air rushes into the vacuum line and on to the suction conduit 28 to release/reduce the vacuum level present in the suction conduit 28 and the drains 12, 14 in communication therewith. In this instance, the vent valve 42 may have at least two positions, a first wherein the transducer is exposed to vacuum in the suction conduit (a vacuum sensing position) and a second which vents the suction conduit to atmosphere (a venting position). A suitable vent valve 42 for this application can be obtained from SMC Corporation of America, of Indianapolis, Ind., Model No. VXV3130.

The controller 48 receives power from a utility supplied power line 52, which extends to a circuit breaker box 54. The controller 48 switches power to the pump 30 on and off via power line 56 and also controls the position of the valves 42, 44 via control lines 58, 60. The occlusion of one of the drains 12, 14 or 22, will trigger a change in the vacuum level present in suction conduit 28. A change in vacuum level is sensed by the vacuum sensor 46 and by the controller 48, which can then respond by opening valves 42, 44 to atmosphere and disrupting power to pump 30. In this manner, suction at the drains 12, 14 and 22 is released allowing any obstruction to be cleared. For example, if a swimmer were to become caught on the main drain 12, the resultant release of suction owing to the venting of the suction line 28 to atmosphere and the discontinuance of pumping will allow the swimmer to remove himself from the main drain 12. Besides executing a drain protection safety function, the controller 48 may also be used to control the times when the pump 30 is operated pursuant to a schedule, as well as when the pump 30 is operated at different speeds. On start-up, the pump in some pool/spa installations requires time to establish a prime, viz., the filling of the suction conduit, strainer and pump housing with water. This is normally accomplished by running the pump at high speed. The pump speed (and associated power consumption that is required to prime the pump) is more than that which is required to maintain effective filtration/circulation once prime has been established. Some states have recently passed laws that require pools and spas to have pumps that are operated at two speeds, namely, at high speed to perform certain functions, such as priming and cleaning, and low speed to conduct filtration at a reduced usage of electrical power. The vacuum release system 39 of the present invention monitors for and responds to vacuum anomalies while pump speed changes are executed. The controller 48 has a display 62 and input keys 64 for an operator interface, allowing the operator to read messages presented on the display 62 by the controller and to provide input, such as selecting menu choices, answers and/or values by pressing selected keys. Some pool/spa systems may have a preexisting controller 65 that controls heating, circulation/filtering, cleaning, chlorination, etc. The controller 48 may be connected to a preexisting controller 65 for the purpose of utilizing the scheduling data entered into the controller 65, thereby acting as an intermediary or co-controller.

The return line 36 has a branch 66 which communicates with the inlet of an optional booster pump 68 that is used to increase the pressure of the fluid from the return line 36 to aid in operating a pressure-type pool cleaner 74. Some pools are equipped with automatic cleaners that utilize the return flow of water from the filtration system to drive various pressure cleaner devices. In some pool systems, the filtration/circulation pump 30 is switched to high power to generate a pressurized flow that is effective at driving a pressure cleaner 74. Still other pool systems utilize a booster pump 68 to increase the pressure of the return flow of water to enhance the effectiveness of a pool cleaner 74 during cleaning mode. The vacuum release system 39 of the present invention is capable of monitoring drain occlusion and pump malfunction while pool cleaning is occurring and during the transitions from normal filtration running to cleaning mode and from cleaning mode back to normal filtration. The outlet of the booster pump 68 discharges into conduit 70 that is connected to a flexible hose 72 leading to the cleaner 74. Power to the booster pump 68 via line 75 may be controlled by controller 48, manually, or by controller 65. A stop switch 76 may be provided with the vacuum release system 39 or an existing stop switch 76 may be employed to signal the controller 48 that an emergency shut down has been ordered. The stop switch 76 may be a normally open switch maintaining electrical continuity in a conductive loop. When pressed, continuity is disrupted, signaling an emergency shut-down.

Figure 2:
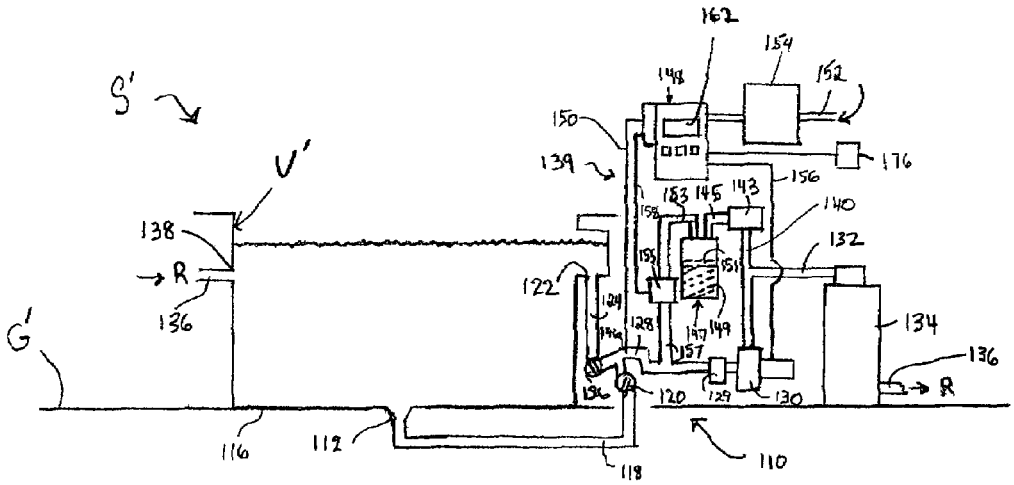
FIG. 2 is a schematic diagram of an above-grade fluid containment vessel and fluid circulation system with drain safety and pump control apparatus in accordance with a second embodiment of the present invention.

FIG. 2 shows a pool/spa system S' with a fluid containment vessel V' that is above ground level G', as would be common for above-ground pools and spas. The pool/spa system S' has a fluid circulation system 110 with one or more drains 112 at the bottom 116 thereof which communicate with a drain conduit 118 that extends to a valve 120. An upper level drain 122, such as a skimmer, communicates with a corresponding drain conduit 124 that terminates at valve 126. The outlets of the valves 120 and 126 are plumbed to a common suction conduit 128 extending from the valves 120, 126 to a strainer basket 129. The strainer basket 129 discharges into the inlet of a pump 130. The pump 130 discharges into outlet conduit 132 which extends to the inlet of a filter 134. The filter 134 discharges into return conduit 136 (shown broken and labeled R) which discharges filtered water into the vessel 110 via a return outlet 138. A vacuum release system 139 releases/reduces vacuum present in the fluid circulation system 110 in response to anomalies such as drain occlusion. More particularly, the outlet conduit 132 has a branch 140 which extends to a one-way check valve 143. The check valve 143 allows fluid flow away from the pump 130 only, but not towards the pump 130. The check valve 143 discharges via conduit 145 to an accumulator 147. The accumulator 147, which functions to store fluid under pressure, includes a pressure vessel containing a resilient member 149, such as a spring, a pocket of air, or an elastomeric material acting against a piston 151. The pump 130 pushes fluid under pressure through the filter 134 and also through the check valve 143 into the accumulator 147, where it displaces the piston 151 against the pressure of the resilient member 149. The pressure developed in the accumulator 147 is stored (even when the pressure in outlet conduit 132 drops) due to the resistance to reverse flow attributed to the check valve 143. An outlet conduit 153 extends from the interior of the accumulator 147 (in communication with the pressurized fluid therein) to a solenoid controlled valve 155 that is opened and closed under the control of controller 148. A vacuum sensor 146 is inserted into the suction conduit 128, the vacuum signal of which is transmitted to the controller 148 via line 150. The sensor 146 may be of the same types as described above for sensor 46. Alternatively, a vacuum line extending from a vacuum transducer positioned on or proximate to the controller 148 to the suction conduit 128 may be employed. The sensor 146, or the alternative vacuum line, is preferably located in proximity to the inlet of the pump 130 on a straight run of pipe at about 45 degrees from the top of the pipe. This position minimizes fluctuations due to aspiration of air. As described above in relation to FIG. 1, when a vacuum line is used to transmit vacuum from the suction conduit 128 to a transducer mounted on the controller 148, the suction line may have a dual function. More particularly, instead of valve 155 discharging into conduit 157, it may discharge into the vacuum line, which communicates with the suction conduit 128. As in the first embodiment, the valve 155 may have at least two positions, a sensing position where the transducer is in communication with the suction conduit 128 and a vacuum release position placing the suction conduit in communication with the accumulator 147 (through the vacuum line).

The controller 148 receives power from a utility supplied power line 152, which extends into a circuit breaker box 154. The controller 148 switches power to the pump 130 on and off via power line 156 and also controls the position of valve 155 via line 158. The occlusion of one of the drains 112 or 122 will trigger a change in the vacuum level present in suction conduit 128. A change in vacuum level is sensed by the vacuum sensor 146 and by the controller 148, which can then respond by opening valve 155 permitting the accumulator 147 to discharge the pressurized fluid contained therein into the suction conduit 128 to pressurize the suction conduit 128 and relieve any vacuum condition that may have previously existed due to an occluded drain. As used herein, the term "fluid" shall have its broadest meaning, encompassing a liquid, such as water, and a gas, such as air. For example, the fluid discharged by the accumulator 147 may include both air and water. The controller 148 also disrupts power to pump 130 to prevent the reestablishment of a vacuum condition in suction conduit 128. In this manner, suction at the drains 112 and 122 is released/reduced allowing any obstruction to be cleared. For example, if a swimmer were to become caught on main drain 112, the resultant release of pressurized fluid from the accumulator 147 into the suction line 128 and the discontinuance of pumping will allow the swimmer to remove himself or herself from the main drain 112. As in the previous embodiment, besides executing a drain protection safety function, the controller 148 may also be used to control the times when the pump 130 is operated pursuant to a schedule, as well as when the pump 130 is operated at different speeds.

Figure 4:
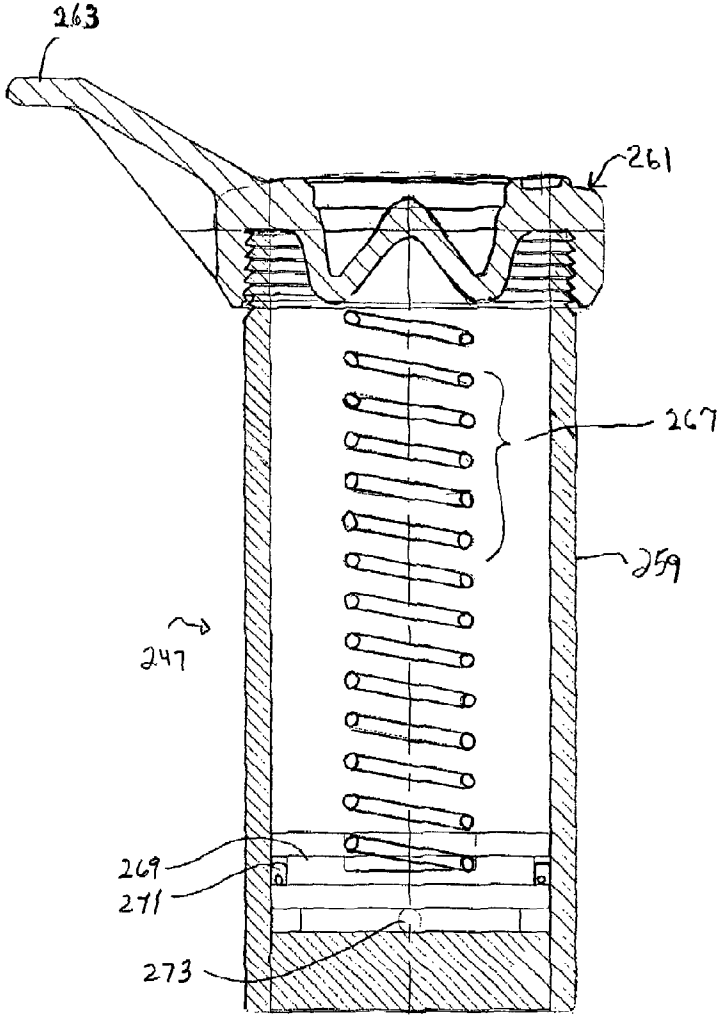
FIG. 4 is a cross-sectional view of the accumulator of FIG. 3 taken along section line IV-IV and looking in the direction of the arrows.
Figure 3:
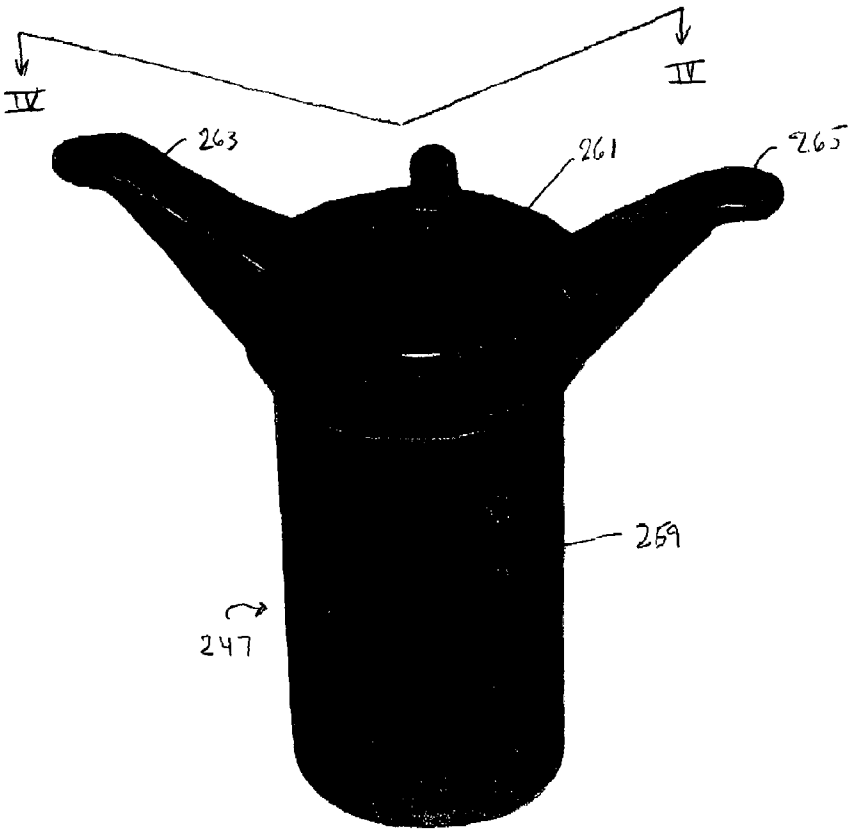
FIG. 3 is a perspective view of an accumulator in accordance with a third embodiment of the present invention.

FIGS. 3 and 4 show an accumulator 247 having an elongated cylindrical body 259 and a threaded cap 261 with a pair of handles 263, 265 for tightening the cap 261 onto the body 259. A spring 267 extends between the cap 261 and a piston 269 with a ring seal 271. An inlet orifice 273 admits fluid under pressure into the interior of the accumulator, where it displaces the piston 269 against spring pressure. As noted above, the spring 267 could be replaced with any resilient member, such as sealed bladder containing a gas, or body made from an elastomeric material.

Each pool/spa system will have different operating characteristics, e.g., vacuum levels in the suction conduits 28, 128, depending upon many factors, such as pool size, water height above ground level, number and size of drains, conduits, pumps, etc. This is true of normal, unobstructed operation during the various functions performed by the system, as well as during degraded operating mode due to the accumulation of debris in filters and skimmers and when experiencing malfunctions due to obstruction or disconnection of a drain line. The vacuum level in the suction conduits 28, 128 will also vary widely depending upon the functional state that the fluid circulation system is in at any given time: start-up; stabilization; filtration; change of speed; and/or cleaning. As a result, it is necessary to ascertain safe and appropriate vacuum levels for all of the various modes of operation of the circulation system, so that the vacuum release systems 39, 139 are triggered under appropriate circumstances to protect the users and the equipment of the pool/spa system during all phases of operation, while allowing the system to operate in a normal and effective manner.

Figure 5:
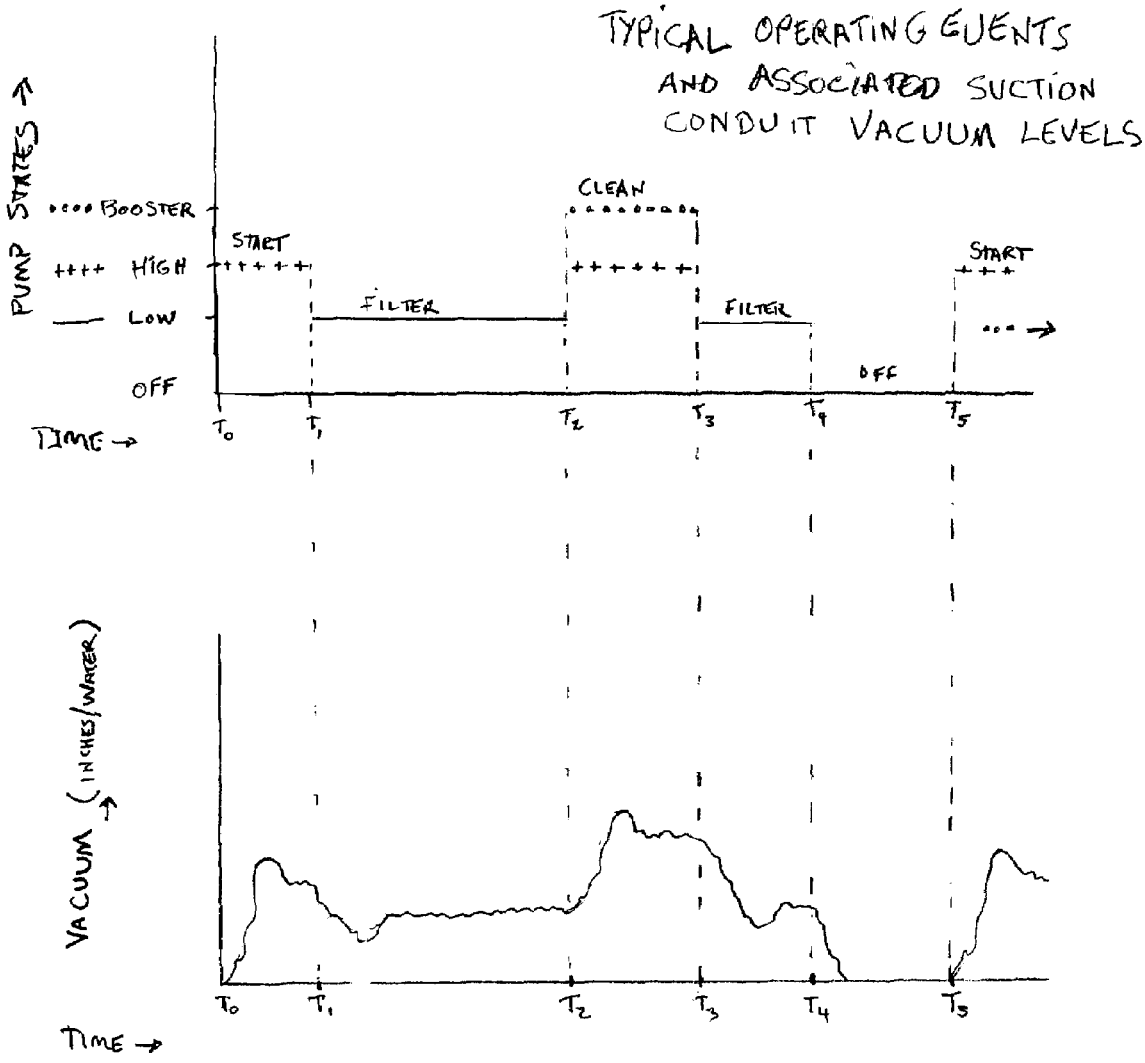
FIGS. 5 through 8 are graphs showing fluid circulation functions and associated vacuum levels related to time.

The upper portion of FIG. 5 graphically shows various operating states of the in-ground pool/spa system S, which includes the two speed pump 30 and the booster pump 68 running normally and not effected by the vacuum release system 29. From time $T_0$ to time $T_1$ the circulation pump 30 is started in high speed to prime the pump 30. This condition is achieved at or before $T_1$, whereupon the circulation pump 30 is set to low speed for filtration purposes, i.e., until time $T_2$. At time $T_2$, the circulation pump 30 is again set at high speed to increase the pressure of the return flow to aid in operating the pool cleaner 74. The booster pump 68 is also activated at time $T_2$ to further increase the pressure of the water reaching the cleaner 74. When cleaning is terminated at time $T_3$, the pump 30 goes back to low speed for filtration until time $T_4$, when the pump 30 is turned off. At time $T_5$, the pump 30 is restarted as at time $T_0$. As shown in the lower portion of FIG. 5, the various states of operation of the pump/circulation system of the pool/spa system S have an associated effect on the vacuum level present in the suction conduit 28 leading to the pump 30. During the starting phase, there is a rapid ramping up of vacuum to a peak and then stabilization at a lower level while the pump 30 runs at high speed. Upon the pump 30 being set to low speed at time $T_1$, the vacuum level ramps down to a valley and then recovers to a higher stable level until reaching time $T_2$. At $T_2$, the ramping up is repeated, but in this particular installation, the peak vacuum level reached by the combined operation of the pump 30 at high speed and the booster pump 68, exceeds that reached by the high speed operation of the circulation pump 30 alone. This would not necessarily be true for all installations.

Previously, pool/spa owners would manually control the functional state of the circulation systems 10, 110 by, for example, turning the pumps 30, 130, 68 on and off, as necessary. Electro-mechanical timers (a clock which mechanically opens and closes contact points) were then used to automatically turn pumps on and off in accordance with a predetermined schedule. More recently, digital programmable controllers, such as the controller 65, have been utilized to activate pumps and other pool/spa equipment in accordance with a predetermined schedule, which the user enters into the controller 65. The vacuum release systems 39, 139 have the capability of working in conjunction with pool systems that are manually controlled, with electromechanically-timed systems and with digitally controlled systems. More particularly, the vacuum release systems 39, 139 may be utilized on manually controlled circulation systems to convert them to automatic systems, since the vacuum release controllers 48, 148 have timing and scheduling capability, enabling users to schedule the running and speed of the circulation pumps 30, 130, 68 in lieu of turning them on and off manually. Alternatively, the owner of a manual pool/spa system may decline to utilize the timing capabilities of the controllers 48, 148 and continue to run the circulation system manually. In the latter case, the vacuum release systems 39, 139 may be used strictly to monitor vacuum levels to promote user safety and prevent equipment degradation (not for pump scheduling). The vacuum release systems 39, 139 may also be employed with an existing controller which is used to schedule and automatically operate the circulation system.

As can be seen in FIG. 5, the functions and vacuum levels associated with different functional states of the circulation systems are time dependent. As a result, the relationship between the vacuum level and time can be used to ascertain appropriate vacuum levels at specific times and/or the appropriate system response to high or low vacuum levels at specific times. For example, if it is known in advance that a high vacuum level is appropriate during a particular phase of operation, then that high vacuum level can be ignored for a certain period, rather than triggering vacuum release.

There are different methods of ascertaining appropriate and safe levels of vacuum for pool/spa systems during various functional states. One method is to conduct testing on various systems in all possible modes of operation in a laboratory setting to arrive at values with common application. For example, testing may reveal a vacuum level $L_D$ that is above all normal operational levels for any system, i.e., the maximum observed level $L_M$ plus a tolerance. This high limit $L_D$, may be used as the default criteria for identifying an anomaly, such as an occlusion of the drains 12, 112. This default, high limit-type triggering of vacuum release by the vent valves 42, 44 and/or the accumulator 147 discharge, can be utilized without reference to the particular operational state of the pool/spa system, the identity of the system and/or the scheduling or timing of different functional states. This process of ascertaining a default acceptable vacuum level $L_D$ by exercising a pool/spa system and then observing the resultant vacuum levels can also be applied to determine the maximum observed rate of change of vacuum level (slope) $S_M$ (either rising or falling) and a default acceptable slope $S_D$ for normal safe operation. A default acceptable rate of vacuum change $S_D$ can be calculated from the maximum observed rate of change $S_M$ by adding a tolerance (see FIG. 6). The slope, e.g., $S_M$, is determined by subtracting former from subsequent vacuum readings and dividing by the time period expired. A high slope value is indicative of a radical vacuum change, such as that associated with an occlusion of a drain conduit by a person. The actual measured slope Sa during operation of the pump/circulation system can be constantly compared to the maximum slope $S_M$ or the default slope $S_D$ to ascertain that it does not exceed it.

An alternative and/or supplemental method of ascertaining vacuum level criteria which provides values that are more sensitive to a particular pool/spa system, is to observe and record actual vacuum levels of a given specific pool/spa system during operation, in various states, and then calculate appropriate vacuum ranges and/or high and low limits for the various potential states of that particular pool/spa system. This type of empirical data can be observed and recorded manually and/or automatically captured and/or calculated by the controllers 48, 148. One approach for collecting relevant empirical vacuum level data is to run the system in a state which results in maximum normal vacuum levels, e.g., while utilizing a pool vacuum attached to the skimmer 22.

In the event that the vacuum release systems 39, 139 of the present invention are used as a timer/controller for the pump/circulation systems 10, 110, respectively, and/or works in cooperation with an existing timer/controller, such as the controller 65, time and functional phase-based monitoring of vacuum levels is possible.

Figure 6:
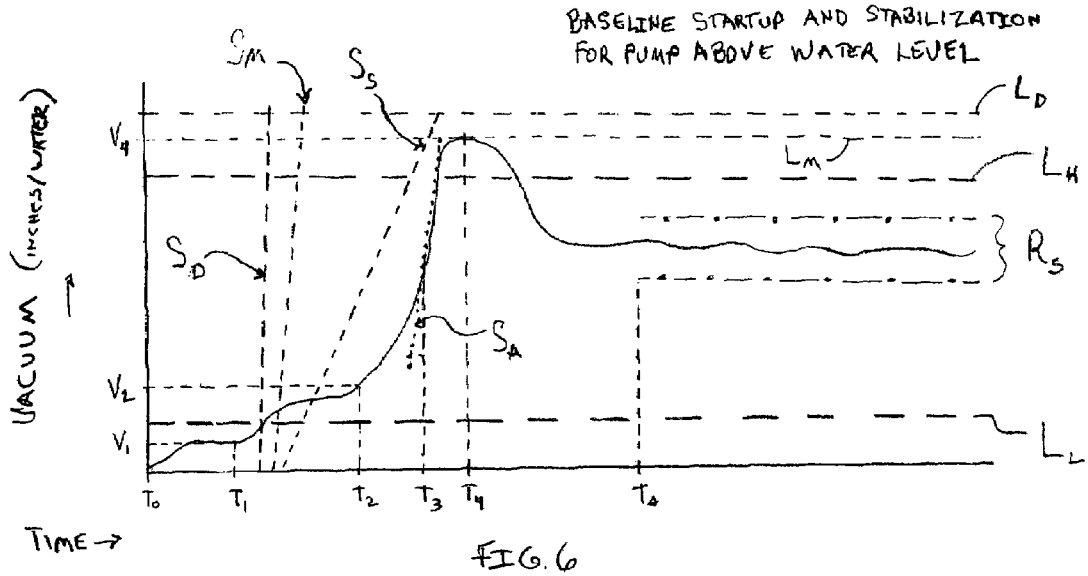

FIG. 6 is an enlarged view of start and stabilization phases of operation of a circulation pump. It could be illustrative of a single speed pump, such as the pumps 30, 130, or of a two speed pump, such as the pumps, 30, 130, started in either high or low speed. The pumps 30, 130 are started at time $T_0$ and at time $T_1$ have developed a vacuum level $V_1$ in the suction conduits 28, 128, respectively. At time $T_2$, the vacuum level is $V_2$ and rapidly ramps up to $V_4$ at time $T_4$. At time $T_3$, the rate of change or slope of the actual vacuum reading is $S_A$. After peaking at time $T_4$, the vacuum level enters a mildly oscillating stabilized region Rs. Given that the vacuum level $V_X$ at any time $T_X$ can be ascertained and stored, the vacuum level profile at start-up and stabilization could be recorded as a table, array or matrix. The top portion of FIG. 9 illustrates a table of measured vacuum values that the controllers 48, 148 can store during various phases of operation of the pool/spa systems S, S' at times $T_1$, $T_2$ . . . , e.g., on installation by a technician. During stabilized modes of operation, such as filtration mode, which will persist for a substantial period without change, measurements need not be taken beyond the time of stabilization, i.e., $T_s$, such that the values for the last relevant time period will apply for an indefinite period thereafter. Given recorded data descriptive of vacuum levels over time, this vacuum profile data can be compared to a subsequent operation of the circulation pump when it performs the same process, i.e., start-up and stabilization, and the readings compared between the first obtained data and the second, to test for consistency or anomaly.

Since there is a great likelihood that the second operation of the pump will generate vacuum readings which are somewhat different than the first operation thereof, a more realistic and meaningful comparison would be between the first recorded vacuum levels +/− a tolerance, such that the determination is whether a second reading falls within a range rather than being exactly equal to, less than or greater than a specific value. As shown in FIG. 9, the measured values $V_1$, $V_2$, etc. can immediately or subsequently be translated into a table of ranges, R1, R2 . . . , against which measured values obtained when the pool/spa system is subsequently run during normal use by the consumer can be compared. Besides monitoring the degree to which the measured vacuum profile is compatible with a normal profile during start-up/priming, the controllers 48, 148 may also time how long it takes to achieve priming and count the number of times the pumps 30, 130 fail to achieve a prime condition within a selected time. Failure to achieve prime within a designated time and/or number of attempts will then result in storage of an error event in the event log and appropriate error processing, such as displaying an error message to the operator and/or shutting the circulation systems 10, 110 down.

Referring again to FIG. 6, in addition to the default anomaly vacuum level, $L_D$, and default rate of change/slope $S_D$, parameters such as, ultra-safe high and low vacuum limits $L_H$ and $L_L$, respectively, and slope $S_S$ can be identified, which are assured to be sensitive to anomalies, since they are violated during normal operation of the pump/circulation system. Exceeding the ultra-safe $L_H$, $L_L$ and $S_S$ limits can be acted upon or ignored based upon the timing/functional context in which it occurs. For example, exceeding the low limit $L_L$ between $T_0$ and $T_1$ can be ignored given that the controller is "aware" that the within this timeframe, $L_L$ must be violated. By way of another example, the peak vacuum between $T_2$ and $T_4$ that exceeds the high limit $L_H$ can be ignored because it is expected. Alternatively, exceeding the high limit $L_H$ or slope $S_S$ may trigger vacuum reduction by the system by de-powering the pumps 30, 130, venting to atmosphere via the valves 42, 44, or releasing accumulated pressure in the accumulator 147 into the conduit 128 until the vacuum level falls below $L_H$ and/or slope decreases below $S_S$. In this case, the vacuum release systems 39, 139 are not used merely as emergency systems when a very high, unexpected spike in vacuum occurs which violates $L_D$ and/or $S_D$; but rather, they operate constantly, affecting vacuum during normal operation of their respective pump/circulation systems. In this manner, the vacuum release system is constantly operational and is being exercised and tested. Furthermore, the trigger level of vacuum/rate of change is of a smaller magnitude, resulting in a system which is more sensitive to anomalies and to activities that can lead to emergencies but have not yet done so.

The maximum slopes $S_D$ and $S_S$ are alternative and/or cumulative criteria that may be applied to control the system based on vacuum readings. As with triggering vacuum release based upon a vacuum level criteria, such as $L_D$, an excessive actual slope $S_A$ can be ignored for a short time if it falls into a predictable and expected time frame relative to the particular function being executed. Alternatively, the excessive slope $S_A$ can trigger vacuum release if using ultra safe criteria $S_S$.

The actual slope $S_A$ can be used to indicate the stabilization of a pump (acquisition of prime) such as is illustrated in stabilization region $R_S$ in FIG. 6, in that the slope readings will be of relatively low magnitude, pass through zero, and will oscillate in sign. Another way of characterizing the stabilization region $R_S$ is that the difference between successive readings is small, indicating that prime has been achieved. While 10 the same can be true of a run-dry condition, a prime condition can be distinguished from a run-dry condition in that a prime condition will exhibit a substantially higher vacuum level than that which is prevalent during a run-dry situation. The stabilization region $R_S$ can be detected based upon the foregoing and therefore the time necessary for the particular system to acquire stabilization after start-up, i.e., time $T_4$, can be observed and recorded.

Figure 7:
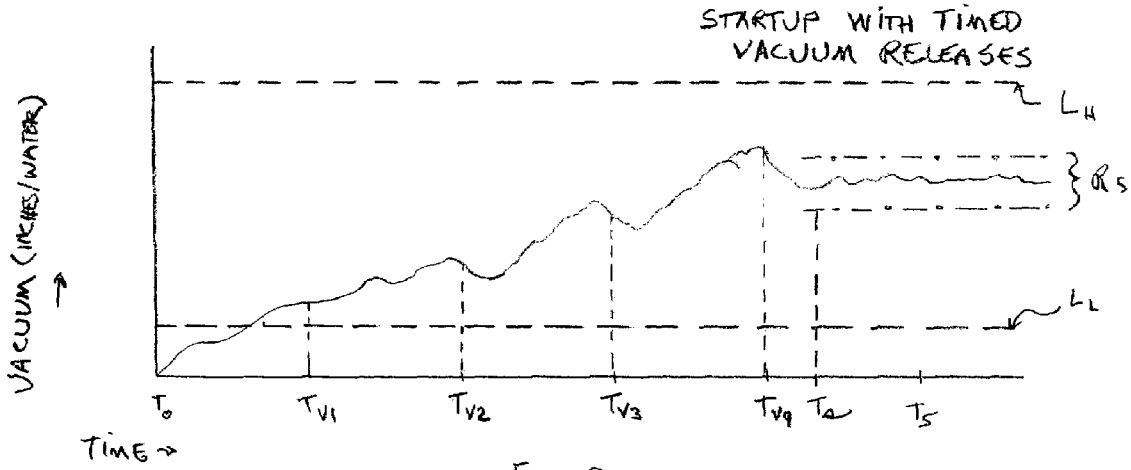

FIG. 7 illustrates another approach to vacuum release/reduction that the vacuum release systems 39, 139 may employ on start-up, as well as at other times, such as filtration. In FIG. 7, the system triggers vacuum release/reduction through venting by the valves 42, 44 or by discharge of the accumulator 147 on a periodic basis, i.e., at $T_{V1}$, $T_{V2}$, $T_{V3}$ and $T_{V4}$ over a selected period of time (between $T_O$ and $T_S$) known empirically to be required to establish prime in the particular system in question. Vacuum release/reduction occurs automatically/programmatically at times $T_{V1}$ through $T_{V4}$, altering the vacuum profile, e.g., from that which appears in FIG. 6. When the pumps 30, 130 are started, e.g., for the first time or at any subsequent time after a pump "off" condition, such as during the normal on/off cycling of the pumps 30, 130, the controller opens the vent valve(s) 42 and/or 44 several times in succession, e.g., once every 3 seconds to "soft start" the system and to warn swimmers/bathers that the fluid circulation systems 10, 110 have been turned on. Alternatively, soft starting can be accomplished in above-ground pools by periodically activating the accumulator release valve 155. During "soft starting", the pumps 30, 130 are not subjected to the inertia of a solid column of fluid present in the drain lines 18, 118 leading to the pumps 30, 130, respectively, but instead may draw air or pressurized water into the suction conduits 20, 128 to lighten the load on the pumps 30, 130, respectively. Swimmers/bathers are warned of pump activation by the sound and appearance of air bubbles and/or intermittent flow being ejected from the return line into the pool or spa. On start-up, a test of the of the vacuum sensors 46, 146 is conducted by determining that a zero vacuum pressure signal is present when the valves 42, 45, or the valve 155, are open and a minimum signal (greater than zero) is obtained during the pump priming cycle when such valves are closed. When the solenoid-controlled valves 42, 44, 155 are being tested, a factory and/or technician set maximum vacuum limit, e.g., $L_D$ (default High Spike vacuum setting) based on the pool configuration provides protection to pool/spa users. If the default high vacuum limit setting $L_D$ is exceeded, the solenoid controlled valves 42, 44, 155 are activated, venting the suction conduits 28, 128 to atmosphere or the accumulator 147 and the pump(s) 30, 130 are shut down. Otherwise, the circulation systems 10, 110 proceed to stabilize $R_S$. As shown in FIG. 7, when soft starting/periodic vacuum releases are used, the time for establishing stability $T_S$ is slightly delayed over that shown in FIG. 6 (normal priming), but the vacuum level never exceeds the ultra-safe high limit $L_H$.

A similar profile as is exhibited in FIG. 7 would be generated by the vacuum release systems 39, 139 sensing upon rates of change in pressure, i.e., exceeding an ultra-safe maximum slope $S_S$ and/or preventing vacuum levels beyond $L_H$, interactively. For example, the profile shown in FIG. 6 would generate a vacuum release/reduction at $T_3$ attributable to an excessive rate of change of the vacuum level (excessive slope) at $T_3$. This would have a similar effect on the vacuum level as that occurring at $T_{V3}$ in FIG. 7.

After the acquisition of prime, and, if applicable, the setting of the pump speed to low speed for filtering operation, the pumps 30, 130 will continue to run at a given speed for a predetermined time, as determined by the technician and/or user based upon factors such as pool use patterns, exposure to wind borne debris, such as dust and leaves, all of which will vary for each installation. As noted above, the length of operation of the pumps 30, 130 will be determined either manually or by a timer, i.e., either that present in the controllers 48, 148 of the present invention or by another timer/controller, e.g., the controller 65, installed on the pool/spa system. During filtration, the vacuum level in the suction conduits 28, 128 is stabilized and will typically stay within a range of approximately +/−0.5 inches of water. Minor variations in vacuum level are common due to the occasional presence of debris, such as leaves on the main drain cover or due to a person passing by or walking on the main drain cover. Because it would not be desirable to shut the system down permanently due to minor variations in vacuum due to predictable and harmless events during normal operation, shutdown is preferably only triggered by a vacuum spike or rate of change that exceeds the selected limit, e.g., $L_H$, $L_D$, $S_S$ or $S_D$, and which is predictive of a malfunction, such as occlusion of a drain by a person or an object. Vacuum measurements are taken at about 1000 samples per second and groups of 10-100 consecutive measurements are averaged, yielding a measured average vacuum level adjustable from one hundredth of a second to every one tenth of a second. These measured average vacuum levels are monitored for a rate of change exceeding the selected limit, e.g., $S_S$ or $S_D$, such as 40 inches of water per second, which would signal an anomaly and cause the controller to enter the Vacuum Anomaly Detected state. By way of further example, any measured vacuum level exceeding 3.0" Hg above a vacuum value predetermined as a normal running vacuum $L_M$, will trigger the Vacuum Anomaly Detected state. As noted above, ultra-safe vacuum criteria can be employed and violations of same are considered within the time/function context and auto restart of the pumps 30, 130 a set number of times is employed. Continuous operation of the pumps 30, 130 in filtration mode may be periodically interrupted by a self-test, wherein the solenoid valves 42, 44, 155 are opened to vent the suction conduits 28, 128, respectively, to atmosphere or to the accumulator 147, thereby causing a drop in vacuum level in the suction conduits 28, 128. The motor circuitry of the pumps 30, 130 can also be tested at this time. If the vacuum level does not respond in the expected manner (drops), e.g., greater than or equal to ½" Hg in response to the opening of the solenoid valves 42, 44, 155, filtration mode is terminated, the event is recorded in an event log, and Vacuum Anomaly Detected mode is entered. Testing can also be initiated by the owner or technician by depressing the "TEST" momentary switch.

Vacuum Anomaly Detected Mode

Upon detection of a vacuum anomaly, the solenoid valves 42, 44, 155 are de-activated within 0.1 seconds, allowing the suction conduits 28, 128 to vent to atmosphere and/or permitting pressurized water stored in the accumulator 147 to enter into the suction line 128. The valves 42, 44, 155 are closed when powered and opened when deactivated. If the solenoid valves 42, 44, 155 are closed in an activated state and opened in a deactivated state, a power failure will result in the opening of the solenoid valves 42, 44, 155. In this manner, an entrapment occurring contemporaneously with a power shutdown, e.g., through a power outage or due to a person pulling the main circuit breaker 54 to the pool in an effort to free someone from a drain, will result in vacuum release. Of course, the alternative setup could be employed, viz., a solenoid valve 42, 44, 155 that is closed when depowered and opened when powered. This alternative may be preferred in systems which are sensitive to the introduction of air, such as those employing DE filters and/or those in which it is difficult to achieve a prime condition. As to the latter, the prime will not be lost by opening the solenoid valve 42, 44, 155, each time the system is shut down.

Upon detection of a vacuum anomaly, power to the pumps 30, 130 could be terminated by the controllers 48, 148, respectively. These actions permit a swimmer/bather to free himself/herself from any drain that they have obstructed. If the vacuum release systems 39, 139 are set to trigger a pump off and vacuum release in response to relatively mild vacuum level changes (ultra-safe mode), after a delay of about thirty seconds, the pump is restarted in Startup mode. The solenoid valve(s) 42, 44, 155 are deactivated periodically during startup to provide a soft start and to warn swimmers of the starting of the pumps 30, 130. The delay on restarting and the soft start provides the swimmer/bather with additional opportunities to get clear of any drains, such as the drains, 12, 14, 112. Each time an anomaly is detected, it is appended to the event log stored in the controllers 48, 148. Before restart, the event log is reviewed by the microprocessor. If the event log contains a given number of vacuum anomaly events within a specific period of time, such as five minutes, then the controllers 48, 148 shut down the circulation systems 10, 110. An alarm may be sounded via speaker 350 (see FIG. 10) and a message is displayed, such as on the displays 62, 162, or otherwise announced. The alarm may be silenced by depressing stop switches 76, 176, or will automatically turn off after a predetermined time period, such as 10 minutes. In order to restart the circulation systems 10, 110, the controllers 48, 148, respectively, require overt user intervention/action, such as responding to instructions/questions posed on the LCD or audibly over a speaker, by pressing combinations of the keys 64 and/or cycling the systems off and on. This same level of user interaction may be employed to prevent inadvertent running of the pumps 30, 130 after a power failure.

The automatic reduction in vacuum level responsive to an excessive rate of vacuum change or excessively high vacuum levels (spikes) by venting the suction conduits 28, 128; or by permitting the accumulator 147 to release; and/or by turning the pump(s) 30, 130, 68 off, may be permanent in the case of a vacuum spike which is totally atypical (higher than $L_D$) and could only be caused by an anomaly, such as complete occlusion of a drain. In such instances, the system may be programmed to shut the pump(s) 30, 130, 68 down until an operator overtly resets the system, e.g., by going through a recovery procedure involving reading and responding to questions and instructions presented on the displays 62, 162.

In the situation where the vacuum release systems 39, 139 operate at a more sensitive level, with vacuum change rate and level limits that are anticipated to be exceeded in the course of normal operation, then the controllers 48, 148 may be programmed to automatically restart after a selected delay of, e.g., thirty seconds, for a given number of times until it shuts down permanently and needs to be overtly recovered. For example, if it is anticipated that the vacuum limits $S_S$, $L_H$ will be exceeded between 3 and 4 times on start-up, then the controllers 48, 148 can be set to automatically restart the circulation systems 10, 110, respectively, a given number of times, such as five or six times, before shutting down and requiring operator intervention to restart. This cycling through vacuum reduction, delay, and restart can be employed during any phase of operation. For example, during stable filtration, if a user places his/her foot on the drain causing the safe vacuum change rate $S_S$ or high limit $L_H$ to be exceeded, then the system may be programmed to reduce vacuum by venting or accumulator discharge, shutting the pumps 30, 130 down for a few, e.g. three, seconds (during which time the user's foot is likely to have moved) and restarting. The variations of suction at the drains 12, 14, 112 are likely to remind the user that he/she is standing on a drain, thereby inducing him/her to move. If the condition persists, i.e., the partial blockage continues, the system can continue to try to restart for a given number of times, after which a shutdown requiring operator intervention will occur.

Figure 8:
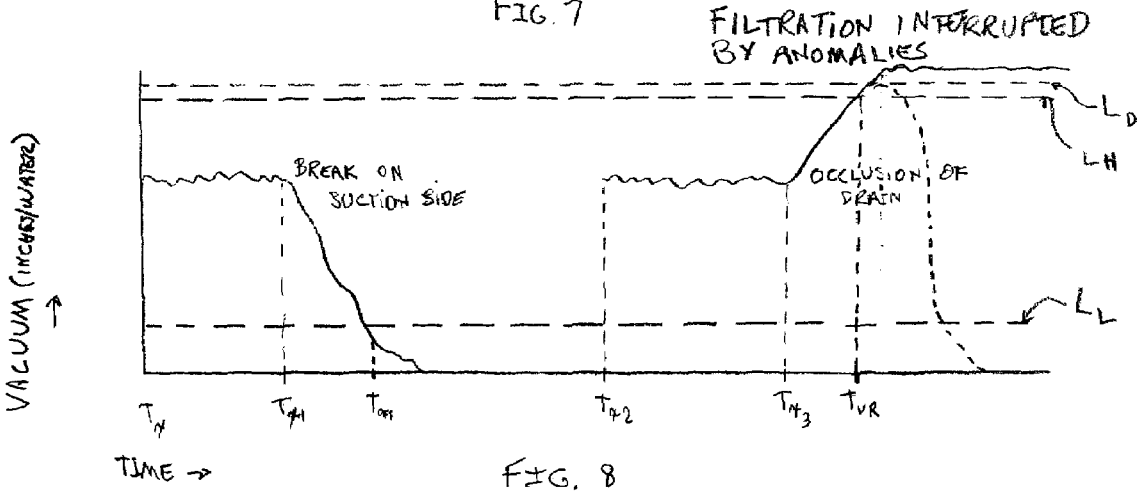

If a low limit $L_L$ is utilized as a trigger to shut down the circulation systems 10, 110, then the time that the vacuum level is anticipated to be below that level, e.g., at the beginning of start-up, must be ignored. FIG. 8 illustrates a situation in which the lower limit $L_L$ would be utilized to trigger a shut down of the pump(s) 30, 130. Namely, if, during stable filtration, the vacuum level drops below the low limit $L_L$, indicative of a broken line or disconnected fitting on the suction side of the pumps 30, 130, the controllers 48, 148 can respond by shutting the pump(s) 30, 130, 68 off at time $T_{OFF}$ to prevent their running dry, a condition that could lead to damage to the pump motor and seals.

FIG. 8 also shows the vacuum profile associated with an occlusion anomaly, e.g., as would occur during stable filtration when an object covers a drain, such as one of the drains 12, 14, 112. At time $T_{VR}$, vacuum release and pump shut down occur, the dotted line showing the resultant vacuum profile and the solid line indicating the vacuum profile in the absence of the vacuum release systems 39, 139. As noted above, depending upon the level of $L_H$ and user preferences, an automatic restart may be attempted after a delay, to allow time for the drain to be cleared.

Figure 11:
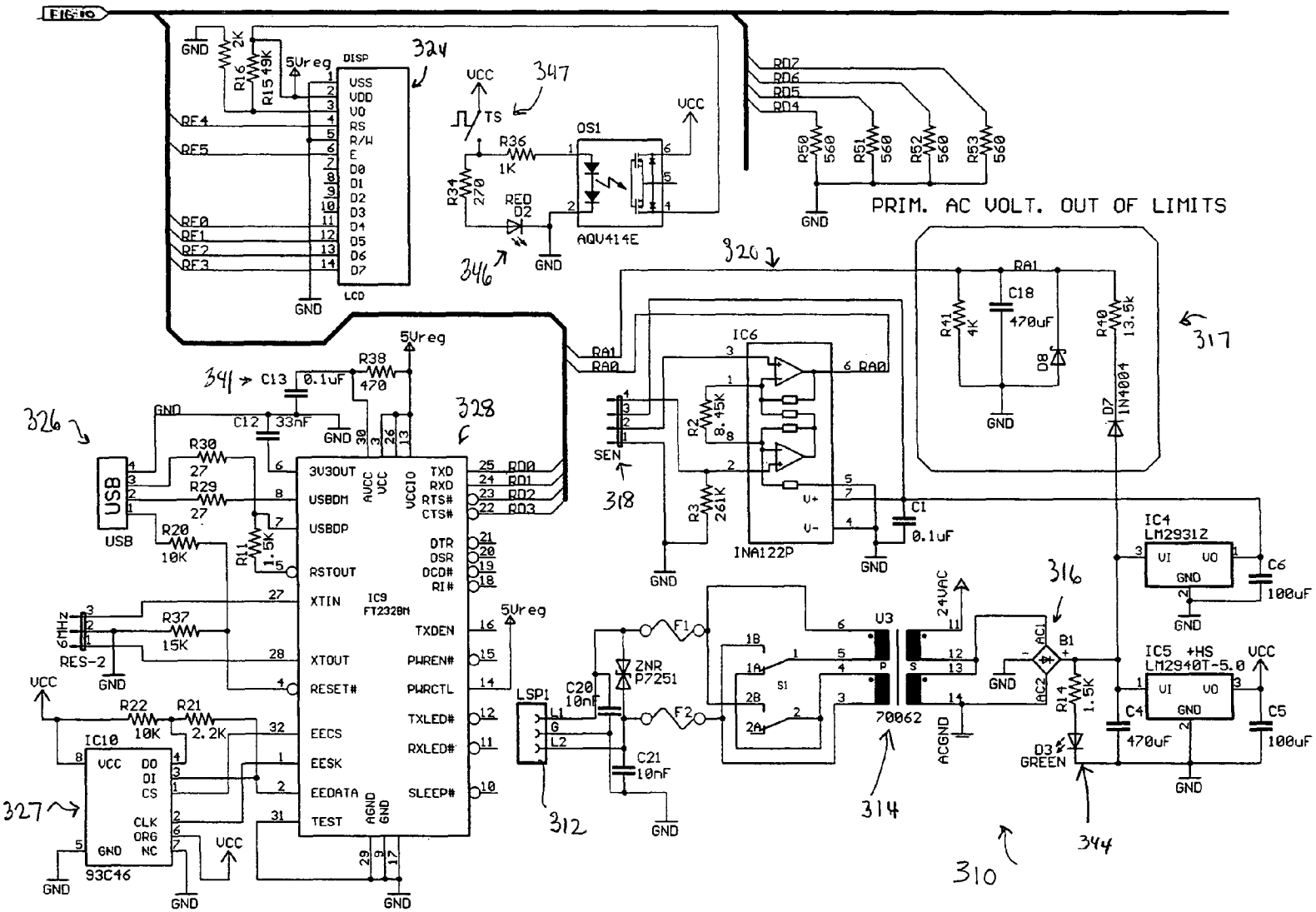

FIGS. 10 and 11 each show a portion of an exemplary controller circuit 310. FIG. 11 shows that the circuit 310 has a power input terminal block 312 to which the residential AC power supply would be attached. The 115, 230 or 208 VAC input voltage is converted to 24 VAC or 24 VDC for activating pump motor relays by a transformer 314. A +5 DC voltage is produced by tapping the transformer 314 and passing 5 VAC through a rectifier 316. This +5 DCV is used to power the various integrated circuits to be described below. Pump motors can be damaged by being connected to a power supply producing an incorrect voltage. A circuit 317 for sensing input AC voltage provides an output signal to a microprocessor 322 (FIG. 10 and depicted by the various input and output ports thereof in a plurality of separate boxes). If the voltage deviates from the required voltage by more than 10%, the power to the pump(s) 30, 130, 68 is disconnected. The sensing circuit 317 is calibrated at the factory to accurately measure the typical input voltages (115, 208 or 230 VAC). The microprocessor 322 is the main integrated circuit which receives the digital inputs created by the other circuit components, executes the control program, and also generates the outputs that control the vacuum release systems 39, 139. On FIG. 11, a vacuum sensor terminal 318 receives the voltage signal produced by the vacuum transducers 46, 146 in contact with the suction conduits 28, 128, respectively. The vacuum signal is amplified and conditioned by a differential amplifier 320 and then provided to the microprocessor 322. An LCD display 324, e.g., a sixteen-character by two-line display, is utilized to display messages from the microprocessor 322 to the operator. A USB port 326 and a USB controller 328 allow data communication between the controller circuit 310 and another computer or data storage device (not shown), e.g., to program the microprocessor 322 or to read data stored in a memory 339, as well as to download the historical events stored in the memory. Program updates can be input to the microprocessor 322 and to a non-volatile flash memory 327 through an IEEE connector and/or the USB port 326. An event log is maintained by storage of data present at specific "events". The following are exemplary events that can be tracked and recorded in the event log: a feature change, such as, an adjustment to: the vacuum high limit, time limit to prime, rate of average change, pump turn on/off as directed by manual operation, programmatic timing and/or in response to safety or malfunction shutdown, entry/exit of pool technician mode, sensor and high spike calibration, time and date setting of the real time clock, automatic self-test with results, download of the event log, resetting of the event log (first entry in log), viewing the event log on the LCD, high or low AC power detected and system response, shut down and abnormal vacuum events including vacuum level detected and the applicable limits. The data associated with each event is stored in memory 339, recording time, date, event code and information about the event, such as vacuum reading present at the time of the event. This data can be retrieved and reviewed at a later time, e.g., by a technician who connects a computer or hand-held device, such as a PDA, to the controllers 48, 148 via the USB port 326. The first entries in the event log may reflect manufacturing steps and test results for testing conducted at the factory. In addition to communication through the USB port 326, the controller circuit 310 also includes an RS-485 transceiver 330 and bus 332 (FIG. 10) for connection to another pool/spa controller, such as the controller 65, that has been previously installed on a pool/spa system. When so connected to the pool/spa systems S, S', the controllers 48, 148 cede control to the existing pool/spa controller 65 with regard to timing the normal operation of the circulation system or parts thereof, but retain control of vacuum level monitoring of the suction conduits 28, 128, the vent valves 42, 44 and/or the accumulator valve 155, while also retaining the ability to turn the pumps 30, 130, 68 off in case of an anomaly. This coordination with an existing controller is accomplished programmatically in the microprocessor 322.

A battery 334 driven oscillator 336 feeds a real-time clock 338 to provide a time reference for conducting programmed/scheduled activities, such as pumping/filtration at various speeds, for timing windows of permissible vacuum levels during pump priming and speed change and for time-stamping events recorded in an event log of events that is stored in memory 327 and/or non-volatile flash memory 339. It is preferable for the flash memory 339 to be able to store at least a thousand of the most recent events. Back-up power to the flash memory 339 is provided for the real-time clock 338 by a super capacitor 341. A programmable timer 340 is provided to time events relative to the actual time and has the capacity to schedule, e.g., one to five, separate daily events each day for a week, or the same separate daily events repeated each day.

Three momentary switches 342 are provided to permit the user to enter data into the controllers 48, 148. More particularly, the switch buttons may be labeled "Up & Yes", "Down & No" and "Menu & O.K. & Test" and can be used to enter answers to questions posed on the display 324, as well as to incrementally change values for date, time and vacuum limits, etc. An LED 344 (FIG. 11) indicates that the system is powered and an LED 346 indicates when a high-temperature condition is sensed by temperature sensor/thermal switch 347, viz., if the system senses a temperature in excess of 70 degrees C. in the controller box, this LED 346 illuminates and the display 324 is shut down to prevent damage from overheating. The illuminated LED 346 indicates that the system is still active even though the display is blank. DIP switches 348 may be used to select the language that the microprocessor displays on the display, 324, e.g., the input voltage, the number of pumps, whether a controller is present, etc.

The controller circuit 310 and connections thereto may be housed in a wall-mounted enclosure made from metal and having a grounding lug to which a connection to earth ground is made. The housing may be compartmentalized to contain the high voltage components in one section separate from the low voltage components which are housed in a separate compartment separated by a conductive barrier that is in electrical continuity with the grounded metal housing. In this manner, the high voltages present in the high voltage compartment are prevented from inadvertently contacting low voltage components contained in the other compartment. The high voltage components may be positioned toward the bottom of the housing with the connector terminals pointed downwards to receive the high voltage power lines inserted into the housing from the bottom. The metal housing may be further protected by a clear plastic outer housing which may be hingedly connected to the metal housing to shield the unit from the weather while permitting an operator to view the LCD displays 62, 162 and the LED's 344, 346. During manufacture, the individual circuit components of the controller circuit 310 are tested as they are installed to debug and isolate defective parts. Upon completion of the assembly, the circuit is powered up for a significant time and then tested multiple times to assure proper operation. Having passed assembly and operational testing in the factory, the controller(s) 48, 148 may then be installed at a user's site by an installer/pool technician.

Installation/Setup by Technician

In preparation for installing the present invention in an existing pool/spa/system, any existing check valves are removed from the suction lines, e.g., suction lines 18, 28. Check valves are frequently used to allow pumps, such as the pump 30, that are installed above the water level of the pool/spa to maintain prime after the pump has been turned off. In order for the present system to work effectively, check valves must be removed that would impede venting the suction conduit 28 to atmosphere or delivering a pressurized back flow of water from the accumulator 147. Before connecting electrical power to the system, the housings of the controller 48, 148 would be opened to access the DIP switches 348, which are set to indicate language preference, to indicate whether there is a one or two speed pump, the input voltage for the controller (selected by switch S1 on the PCB board) and other voltage loads, to indicate if a booster pump, such as the pump 68, is present in the system and to indicate whether the vacuum release systems 39, 139 will control the running of the pump (s) 30, 130, 68 on a time schedule or schedules, as applicable, etc. In order to connect the controllers 48, 148 to the power supplies 54, 154, respectively, to the vacuum sensor/transducers 46, 146 and to the pumps 30, 130, 68, the panel protecting the high voltage terminals in the controller housing is removed. The technician can then connect: (1) a remote stop switch, which is normally closed in "run" mode; (2) the terminal pair for a remote alarm relay (normally open—115 volts @5 Amps); a plurality of terminal pairs to pump motor relays (contactors); and the AC power source (115, 208 or 230 VAC). The power cables to the one or two speed pumps 30, 130 and optional booster pump 68 are connected to AC contactor terminals, routed through the bottom of the housing and connected to the respective pump motors. The pump motors are typically rated at up to 1.5 hp at 115 volts or 3 hp at 208 or 230 volts. In the event that a higher power pump is utilized, the contactors can be used in series with the pump motor starters. Each of the motor contactors is controlled by a separate I/O pin of the microprocessor 322. The housings of the controllers 48, 148 are grounded to the electric supply circuit breaker/fuse boxes 54, 154, respectively and also to the bonding system for the pool/spa, if available. The housings can then be reassembled and power to the systems 39, 139 can be turned on. The voltage sensing function of the system is immediately operative and will confirm that suitable voltage is present to power the controllers 48, 148, the solenoid valves 42, 44, 155 and the pumps 30, 130, 68 via a message displayed on the displays 62, 162, respectively.

The controllers 48, 148 have different access classifications, viz., manufacturer, installer/technician and consumer, which allow successively more limited access to controller settings and values. Some settings are accessible to the owner/operator and some are reserved for installer/technicians and factory technicians. Each controller is set for user access when it leaves the factory. Access by technicians can be password protected or require a proprietary sequence of momentary switch depressions or the like.

Having gained access, the technician can then communicate commands and settings to the microprocessor 322 by depressing the momentary switches 342 in conjunction with and in response to the display of prompts from the microprocessor 322 displayed on, for example, the displays 62, 162. The technician can set the initial parameters for the particular installation, including: the value corresponding to a default high vacuum spike criteria $L_D$ which would indicate an occlusion; the value for ultra-safe vacuum level $L_H$ during filtration; and the delay before restart is attempted. In appropriate cases, the installing technician will exercise all of the pool and spa functions, such as, priming, filtering, speed changes, etc., and observe and record the timing and vacuum levels associated with those functional states. Alternatively, the controllers 48, 148 can automatically capture this data as the circulation systems 10, 110 are exercised. The technician may exercise these systems by following written instructions or by following cues displayed on the displays 62, 162. The technician would then exit custom set-up mode and enable pump protection from abnormal AC voltages. A data display mode would then be entered which dynamically displays operational parameters based upon sensed empirical sensor readings/values, such a vacuum readings in the suction conduit 28. These are typically expressed in inches of mercury.

Besides controller setup, the technician can perform certain maintenance tasks, as well as all the user functions that are available in user mode. The controllers 48, 148 automatically shut down pump operation when technician mode is entered. One of the special functions available only in technician mode is to override shutdown due to excessively high vacuum readings. This shutdown override is sometimes necessary to clear obstructions, such as leaves, that may at times clog the drains 12, 14, 112 that could not otherwise be conveniently removed. Of course, during override, the technician must be certain that the pool/spa is not being used by any persons.

User Preference Selection—Setup/Maintenance

The user can perform the following at any time via the operator interface (input keys 64 and display 62): initiate a self-test; set the real-time clock 338, and schedule events to be executed in the future programmatically, such as the schedule of pump operation, viz., times for turning the pumps 30, 130 on and off, for running them at high and low speed and for turning the booster pump 68 on and off for cleaning purposes. The technician can also view the most recent events that have been logged into the event log and step back sequentially to view prior events. The user can review the recorded log of errors that have occurred and respond to any questions posed by the controller 48, 148. Responding to certain questions may be required before the controller will permit access to certain functions or effecting selected settings.

Figure 12:
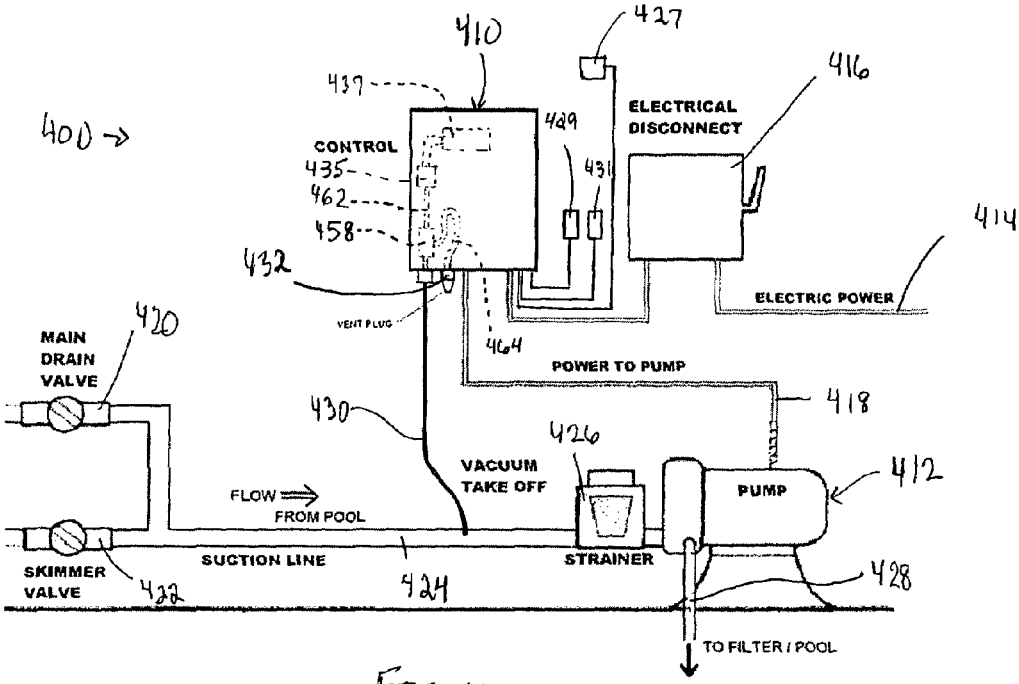
FIG. 12 is a schematic diagram of a drain safety and pump control apparatus in accordance with a third embodiment of the present invention for use with an above-grade fluid containment vessel and fluid circulation system.

FIG. 12 shows a vacuum release system 400 with a controller 410 that controls the electric power delivered to pump 412. As in previous embodiments described above, electrical power is provided on power supply line 414 which passes through a circuit breaker box 416 and to the controller 410 which then powers and depowers the pump 412 via line 418. As before, the pump 412 is used to draw water from a pool or spa (see FIG. 1), which is then routed through a filter via return line 428 before returning to the pool/spa. Water is routed through main drain valve 420 and/or skimmer valve 422 to a suction conduit 424 and into a strainer 426 that removes debris in the water. A vacuum conduit 430, e.g., copper or plastic tubing, extends between the suction conduit to the controller 410. A vent 432 is provided on the controller to allow air to enter the vacuum conduit 430 and the suction conduit 424 to reduce the vacuum present therein, as controlled by a solenoid valve 458. More particularly, the solenoid valve 458 has at least two positions: i.) a first establishing fluid (vacuum) continuity between vacuum conduit 430 and conduit 462 leading to vacuum sensor 435; and ii.) a second establishing continuity between vacuum conduit 430 and conduit 464 leading to vent 432 to atmosphere. As noted above, vacuum sensor 435 may be of the piezoelectric or diaphragm type, e.g., Model No. 22PCCFB6G, manufactured by Honeywell. The electrical output of the vacuum sensor 435 (change in resistance, voltage or current) is conveyed to the microprocessor 437 (see also 322 in FIG. 10) to indicate the vacuum level in vacuum conduit 430. A visual (light) and/or audible alarm 427 (bell, buzzer, speaker, etc.) may be used to announce an emergency condition. A kill/stop switch/panic button 429 is wired to the controller 410 to permit the operator to turn the pump(s) off and release vacuum in the suction conduit 424 (and attached drains). A spare switch 431 may be employed to override controller 410 operation of a pump or pumps, for example, to turn the filtration pump on HIGH and/or to turn the booster pump ON for cleaning the pool out of the predetermined schedule of operation.

Figure 13:
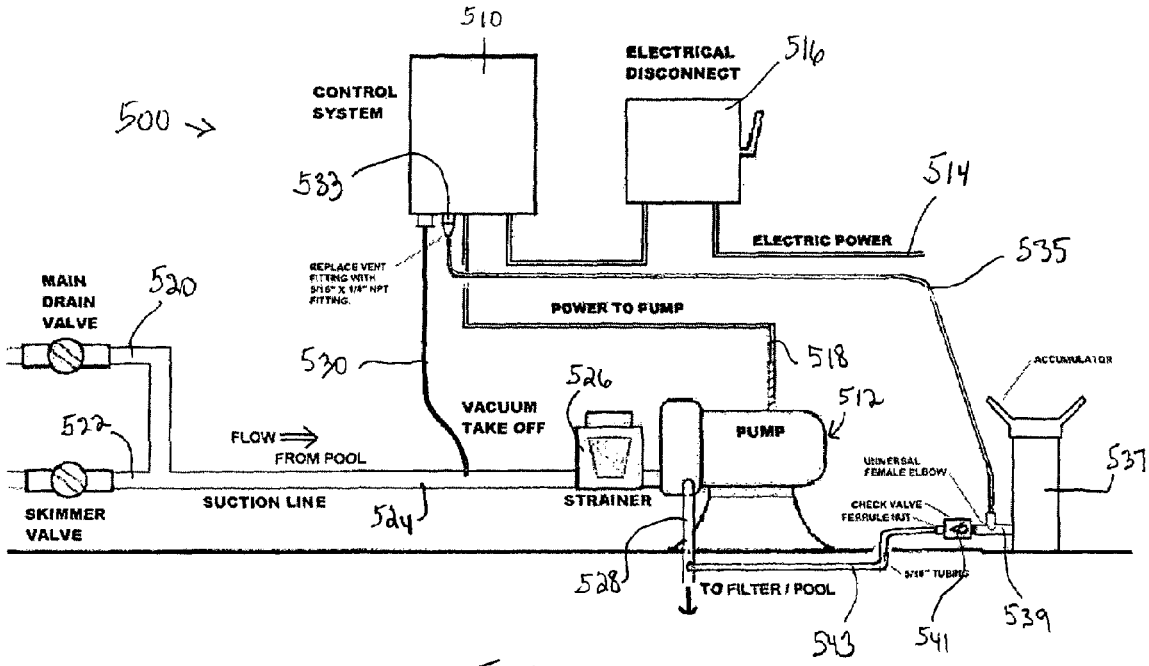

FIG. 13 shows a vacuum release system 500 with a controller 510 that controls the electric power delivered to pump 512. As in previous embodiments described above, electrical power is provided on power supply line 514 which passes through a circuit breaker box 516 and to the controller 510 which then powers and depowers the pump 512 via line 518. As before, the pump 512 is used to draw water from a pool or spa (see FIG. 1) which is then routed through a filter via return line 528 before returning to the pool/spa. Water is typically routed through main drain valve 520 and/or skimmer valve 522 to a suction conduit 524 and into a strainer 526 that removes debris in the water. A vacuum conduit 530, e.g., copper or plastic tubing, extends between the suction conduit to the controller 510. The solenoid valve, vacuum sensor, associated conduits, and microprocessor are the same in the embodiment shown in FIG. 12, so for simplicity of illustration are not redepicted in FIG. 13. A fitting 533 is provided on the controller 510 to couple a pressurized fluid conduit 535 thereto. An accumulator 537 has an outlet fitting 539 to which a reverse flow conduit 535 attaches. A check valve 541 is connected to another branch of the outlet fitting 539 and receives an end of pressurized fluid conduit 543 which fluidly communicates with outlet line 528. Fluid under pressure of the pump 528 courses through conduit 543, through check valve 541 and into the accumulator 537 during normal filtration. The energy of the pressurized fluid is stored in the accumulator 537 via a resilient member, such as a spring acting against a piston or a pocket of gas, such as air in a bladder. Fluid flow into the accumulator ceases when an equilibrium between the pressure of the fluid and the resilient member is established. Once past the check valve 541, the fluid under pressure is trapped within the accumulator 537 and the conduit 535 until it is released into the suction line 524 via the vacuum conduit 530 and a solenoid valve 458 (See FIG. 15) contained within the controller 510. This pressurized fluid can be used to reduce vacuum pressure present in the suction conduit, e.g., attributable to a person being trapped on a drain, as shall be explained further below. The embodiment shown in FIG. 13 reduces the vacuum present in suction conduit 524 by a reverse flow of pressurized fluid from the accumulator 537, rather than by venting the suction conduit 524 to atmospheric air as in the embodiment shown in FIG. 12. This type of vacuum reduction mechanism is especially appropriate for above-ground pools/spas where the water level is above that of the pump/strainer, also described as an installation with "flooded suction". The embodiments of the present invention shown in FIG. 13 may incorporate a kill switch 429, spare switch 431 and alarm 427, as shown in FIG. 12. Similarly, any of the embodiments disclosed herein, for example, in FIGS. 1, 2, 12 and 13 may include the features shown in another of the embodiments, such as booster pump 68, accumulators 537, spare switches 431, etc.

Figure 14:
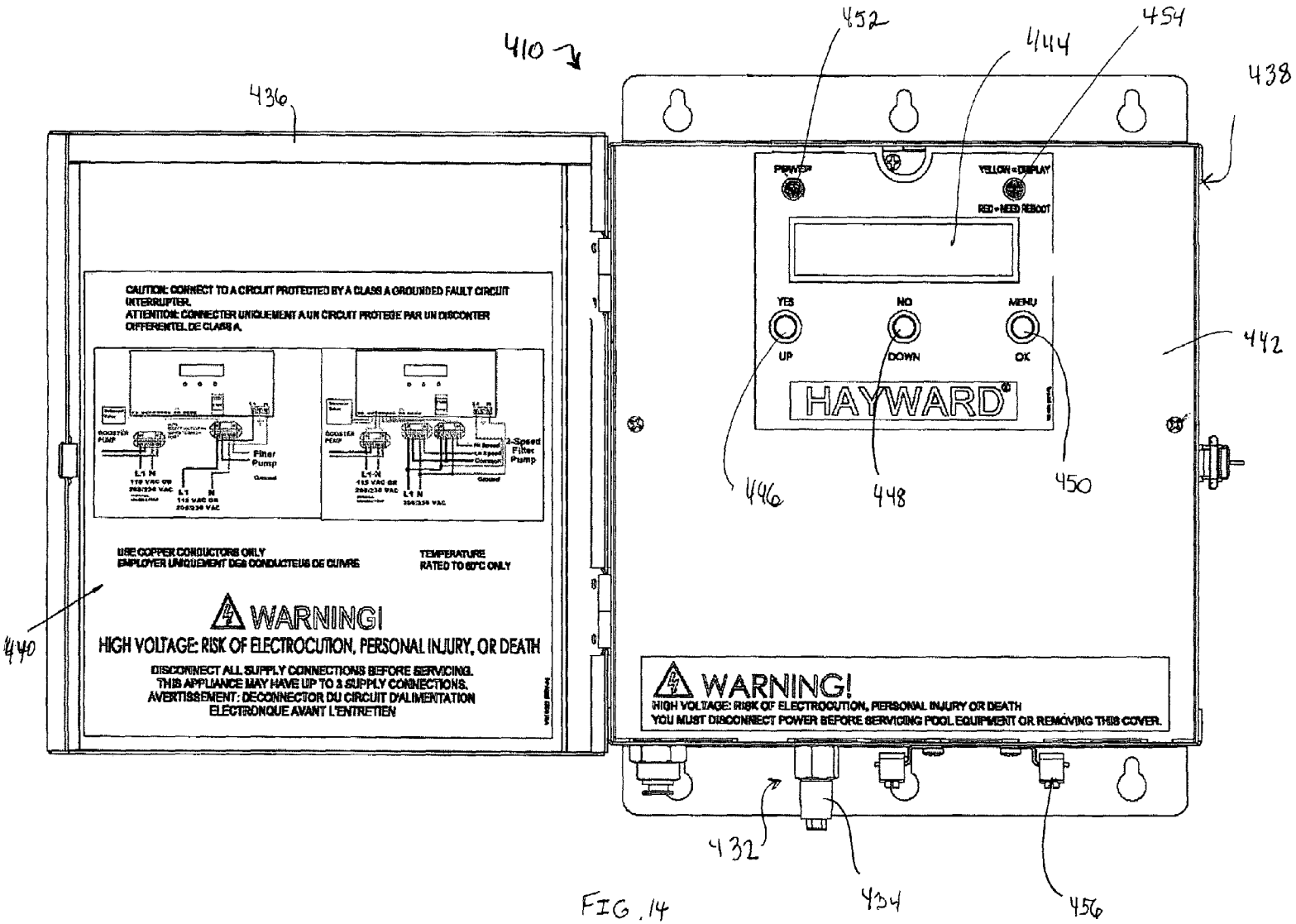
FIG. 14 is a front view of a control system of the drain safety and pump control apparatus of FIG. 12 with the enclosure door opened to show the operator panel.

FIG. 14 shows the controller 410 with the access door 438 of the housing 436 open, revealing decals 440 with instructions for wiring the controller 410 and the inner panel 442, which shields pool/spa owners from contacting the interior circuitry of the controller 410 to prevent shocks. The inner panel 442 also frames and bears indicia for indicating the identity/function of operator interface components, such as the display, 444, three control buttons 446 (YES/UP), 448 (NO/DOWN) and 450 (MENU/OK), a power indicator 452 and a display/reboot indicator light 454. The vent 432 incorporates a filter element 434, which may be made of conventional filter materials, such a sintered brass, metal gauze, paper, etc. The filter 434 prevents debris from entering the vent 432 and also prevents the vent from becoming occluded resulting in interrupted or diminished functioning. Bonding lugs 456 are provided on the housing 438 to receive grounding wires (not shown).

Figure 15:
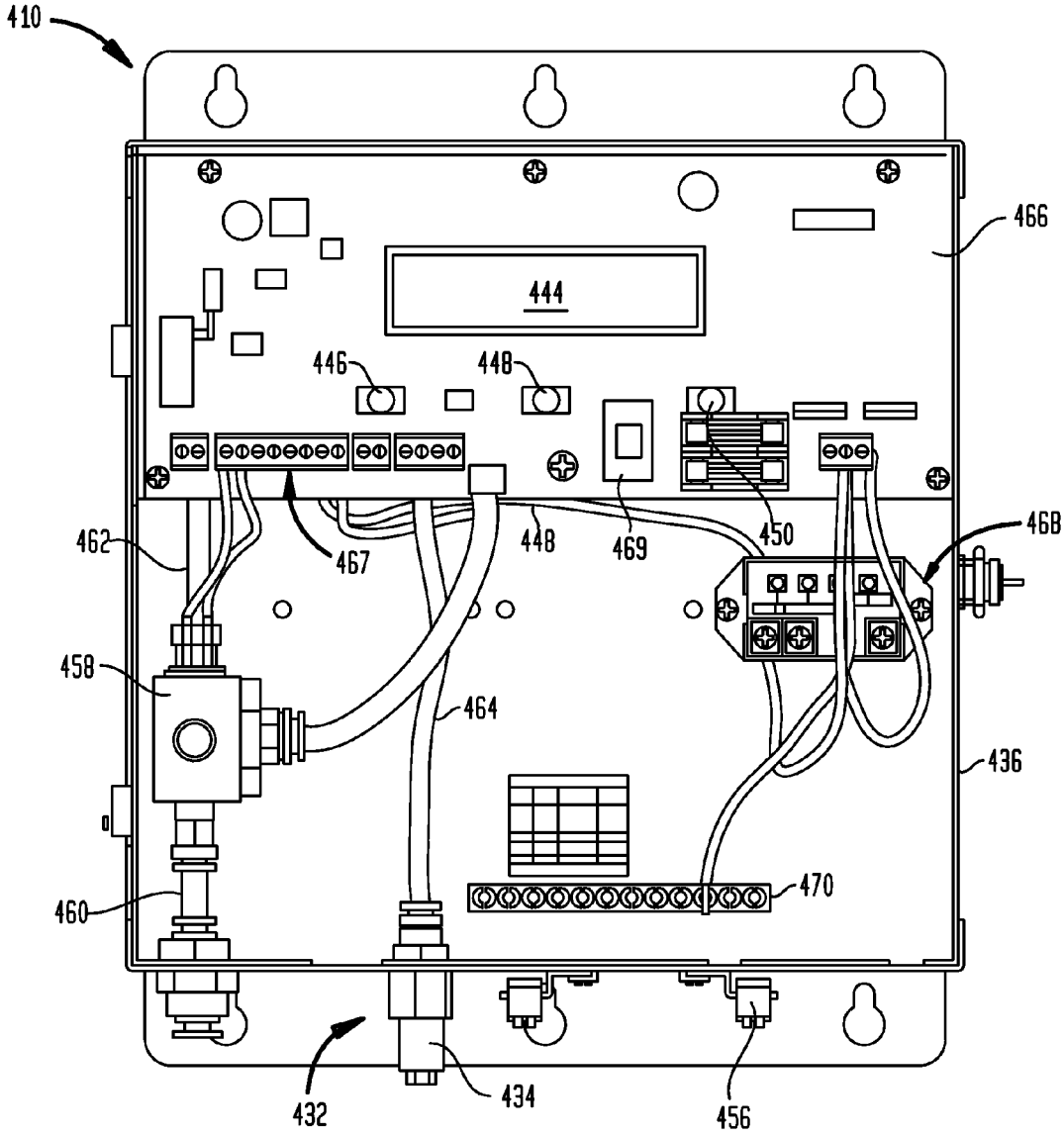
FIG. 15 is a front view of the control system of FIG. 14 with the enclosure door and operator panel thereof removed.

FIG. 15 shows the controller 410 with the inner panel 442 removed, revealing solenoid valve 458 which controls the fluid (vacuum/air/water) communication of conduits 460, 462 and 464. Printed circuit board 466 includes the display 444, the buttons 446, 448 and 450 terminals 467 and input voltage selector 469. A pump terminal block 468 and a grounding lug 470 are positioned below the circuit board 466.

Figure 16:
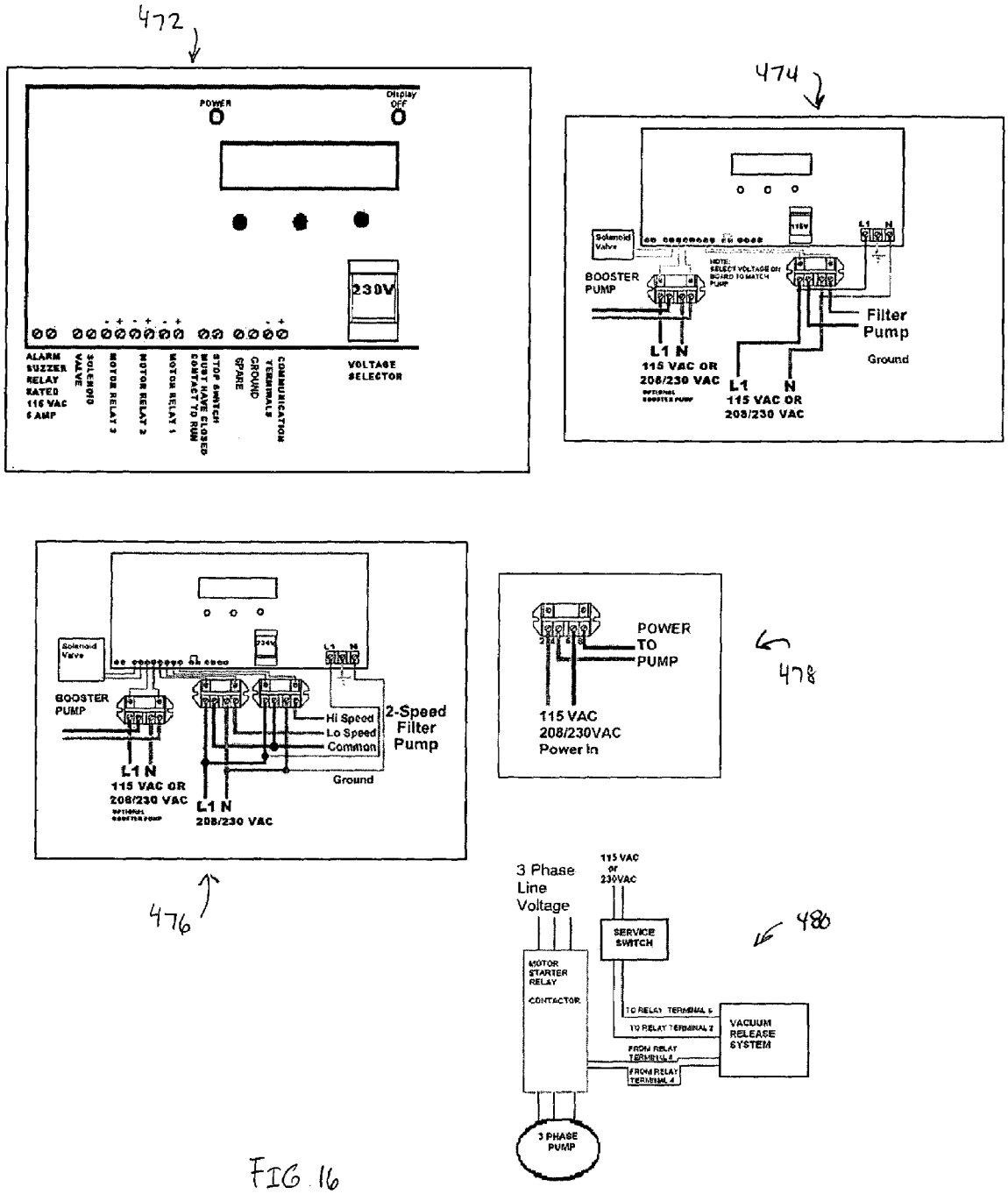
FIG. 16 shows wiring and terminal diagrams for connecting electrical power and pumps to the control system of FIG. 14.

In FIG. 16, a diagram 472 shows exemplary terminal assignments. Diagram 474 illustrates exemplary wiring for electrical input power terminals to power a filter pump and a booster pump. Diagram 476 illustrates exemplary wiring connections to power a booster pump and a two-speed filter pump. Diagram 478 illustrates the terminal connections for powering a single speed pump. Diagram 480 illustrates the wiring connections for powering a three-phase pump.

Figure 17:
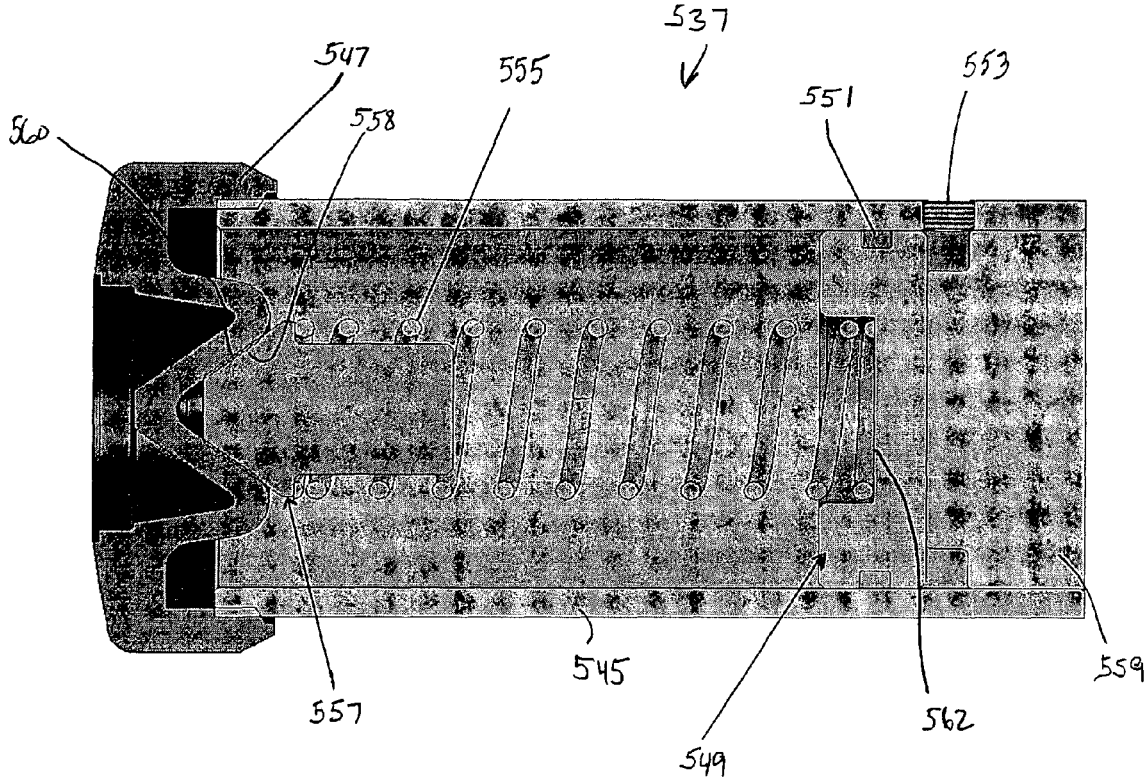
FIG. 17 is a cross-sectional view of an accumulator in accordance with an embodiment of the present invention.

FIG. 17 shows an accumulator 537 having a generally cylindrical body 545 closed at one end by a top cover, which may be secured to the body 545 by threads and/or other retaining means, such as a clamp band. A piston 549 having an o-ring seal 551 is coaxially received within the accumulator 537 and is urged away from the cover 547 by a spring 555. A spring guide 557 has a pointed end 558 that fits within a complementarily shaped depression 560 in the cover, with the other end inserting into the spring 555 to center the spring 555 relative to the cover 547. A depression 562 is provided in the piston 549 to center the spring 555 relative thereto. The body 545 of the accumulator 537 is closed at the end opposite to the cover by a plug 559. A threaded opening 553 passes through the body 545 proximate the plug 559 to admit fluid under pressure into the accumulator to displace the piston 549 towards the cover 547, compressing the spring 555. The threads in the opening 553 may be used to secure a fitting like outlet fitting 539 in fluid-tight relationship to the accumulator 537.

Figure 18:
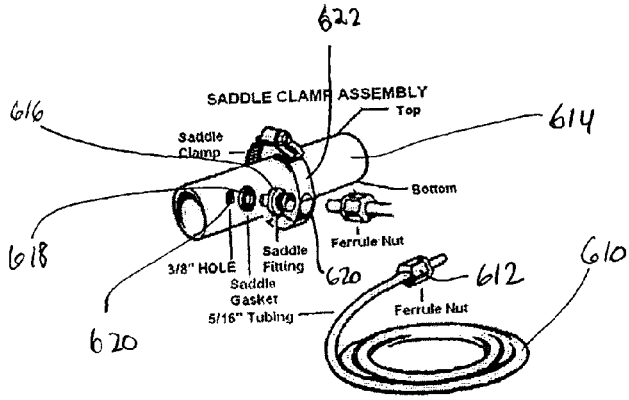
FIG. 18 is a perspective view of a line tapping assembly for connecting a vacuum line to a suction conduit in accordance with an embodiment of the present invention.

FIG. 18 shows a line tapping kit 600 for connecting tubing 610 (e.g., for use as a vacuum line, e.g., 530 and/or pressurized fluid line, e.g., 543) to a conduit 614, such as the suction conduit 524. The conduit 614 is drilled and a tap fitting 616 is inserted in the drilled hole 620 with a gasket 618 there between. A clamp 622 pushes the tap fitting 616 into the hole 620 when the clamp 622 is tightened, the tap fitting 616 inserting into a hole 623 in the clamp 622. A ferrule nut 612 disposed on an end of the tubing 610 may then be threaded onto the tap fitting 616 to make a fluid-tight connection.

FIGS. 19*a-f* show a flow chart 700 of the operation of an exemplary embodiment of the present invention. The system, e.g., 400 or 500, including the controller thereof 410, 510 is powered ON 710. (For purposes of simplicity of illustration, the system 400 will be referred to in describing the functionality expressed in the flowchart 700. It should be understood that any of the embodiments disclosed herein could utilize this same functionality. ) The controller 410 may be powered ON in different contexts, e.g., after manufacture for testing, in the course of installing the system at a residence, by the owner of a pool/spa to input his/her preferences for operating the pool/spa, by the owner during maintenance, for first use of his pool/spa after being shutdown, for maintenance by the owner, by technicians, etc. The context in which the controller 410 is powered ON 710 is determined by operator input, switch settings, and/or states in the system 400 that indicate the context. After power is applied, the controller 410 (programmatically in the microprocessor, e.g., 322) conducts an internal test 712 to determine if "initial start is enabled". This state is initialized to the negative, i.e., the system does not start immediately upon turning the power ON 700, to provide the operator with control over the system 400, i.e., to send power to the pumps, e.g., 412, etc. only when the operator has determined that he/she is ready and it is safe to do so. The operator is queried 714, "Initial Start Now?". If any other key is pressed or if no key is pressed in response, then the controller will idle indefinitely without applying power to the pumps (starting). If the "Y" key is depressed to indicate "Yes", then the operator is queried 718, "Disable Start Delay?". If the "Y" key is depressed within a given opportunity time, e.g., five seconds, then the initial start delay is disabled (by setting an internal flag or variable value). The consequence of disabling the start delay will be that system 400 will immediately implement controlled functioning upon applying power 700 to the controller 410 in the future.

At step 726, the controller 410 internally checks to see if DIP switch 5 is "ON" to indicate that the context of powering up 710 is in the manufacturing environment, e.g., pursuant to testing the functioning of the controller 410. If so, then such testing is conducted 728. The manufacturing tests would involve applying inputs to the controller 410 and ascertaining that the controller responds with the correct outputs/responses. For example, known vacuum levels may be applied to the controller (through the solenoid valve to the vacuum sensor) to see if the controller responds appropriately thereto, e.g., shutting off power to the pump when the vacuum level exceeds a preselected threshold, as shall be described further below and as previously described above. Similarly, the power supply can be varied, e.g., via a variac to ascertain that the controller 410 responds appropriately to such variations, e.g., responding to a low power condition with the appropriate warning messages and shutting power to the pump off. The controller 410 can also be checked to confirm that it outputs the proper messages making up the operator interface and responds appropriately to operator input.

In the event that the manufacturing context is not applicable at step 726, then the controller (via the display 444 thereof) displays 730 the message "Hayward Pool Products, Inc." or similar introductory messages identifying the manufacturer or otherwise communicating with the operator. This is followed by displaying 732 the date and time. In the eventuality 734 that the operator wishes to clean the pool/spa e.g., by using a pool vacuum, the operator can so signify by simultaneously pressing the "Menu" and "N" keys. Note that checking 734 whether the operator wants to clean the pool or not is not necessarily a overt query posed to the operator via the display 444, but rather is initiated by the operator pressing an improbable combination of keys on the operator interface to indicate that cleaning the pool is desired. In this manner, inadvertent selection of this option is avoided and the selection may be made only by someone who has learned how to operate the controller, e.g., by reading the manual or by receiving operating instructions from a technician or other knowledgeable person. In the event that the operator of the pool/spa (be that the owner, a technician or installer) indicates that they want to clean the pool/spa, the Clean Pool Function is invoked 736. The Clean Pool Function allows the pump, e.g., 412, to be operated at high speed and also allows the booster pump, e.g., 68 to be operated without monitoring the vacuum level. This is permitted because the process of vacuuming/cleaning may cause the vacuum level to spike in the normal course thereof. In order to permit vacuuming/cleaning of the pool/spa, vacuum monitoring must be overridden for a time. Before entering this unmonitored mode, the operator is warned 738 on the display 444 that the pump is about to be operated in unprotected (no vacuum monitoring) mode and that the pool must be cleared of all persons. The controller then queries the operator 740 to determine if the pool has been cleared. If the answer is "Yes", unmonitored operation of the pump 742 is performed. Pool cleaning mode will not begin until the operator indicates the pool is cleared of swimmers. Upon such indication, unmonitored operation persists for a given time, whereupon unmonitored operation comes to an end based upon the expiration of a predetermined time window, e.g., a given number of minutes, which can be determined by factory set defaults, or alternatively, this may be a variable set by the installer or the pool owner upon installation/reinstallation. As with operation of the controller 410 generally, all operational states are recorded in an operational log (in non-volatile memory or media).

Assuming that cleaning mode has been skipped or completed, the controller 410 then queries 744 if the operator wishes to set the Time and Date. If so, the Time and Date functions 746 are executed, which are conventional, such as would be encountered in setting the time and date on any modern appliance or clock. The controller then ascertains if Timer event setting has been enabled (by setting DIP switch 4 "On" previously, e.g., during installation. If so, the operator is queried 748 if they want to Set Timer Events. If the operator indicates "Yes", the Timer Events Function is invoked 750. The Timer Events are used to control the ON and OFF times of the filter pump, e.g., 30, the booster pump, e.g., 68, and the high and low settings of two-speed pumps, e.g., 30. The timed events may be scheduled for daily execution (every day of the week has the same schedule of events) or each day of the week can be assigned a custom schedule, which may or may not be the same as another day of the week, e.g., to accommodate the individual's preferences and schedule of usage of the pool/spa. DIP switch, flags or other variable settings with values assigned on set-up or installation can be used to indicate the presence of two speed pumps and/or booster pumps in the system. Alternatively, the controller can sense on the wiring connections thereto to ascertain the presence of specific equipment configurations. The Set Timer Events Function 750 steps through each device to ascertain from operator input when the devices should be turned ON and OFF each day of the week.

Figure 19A:
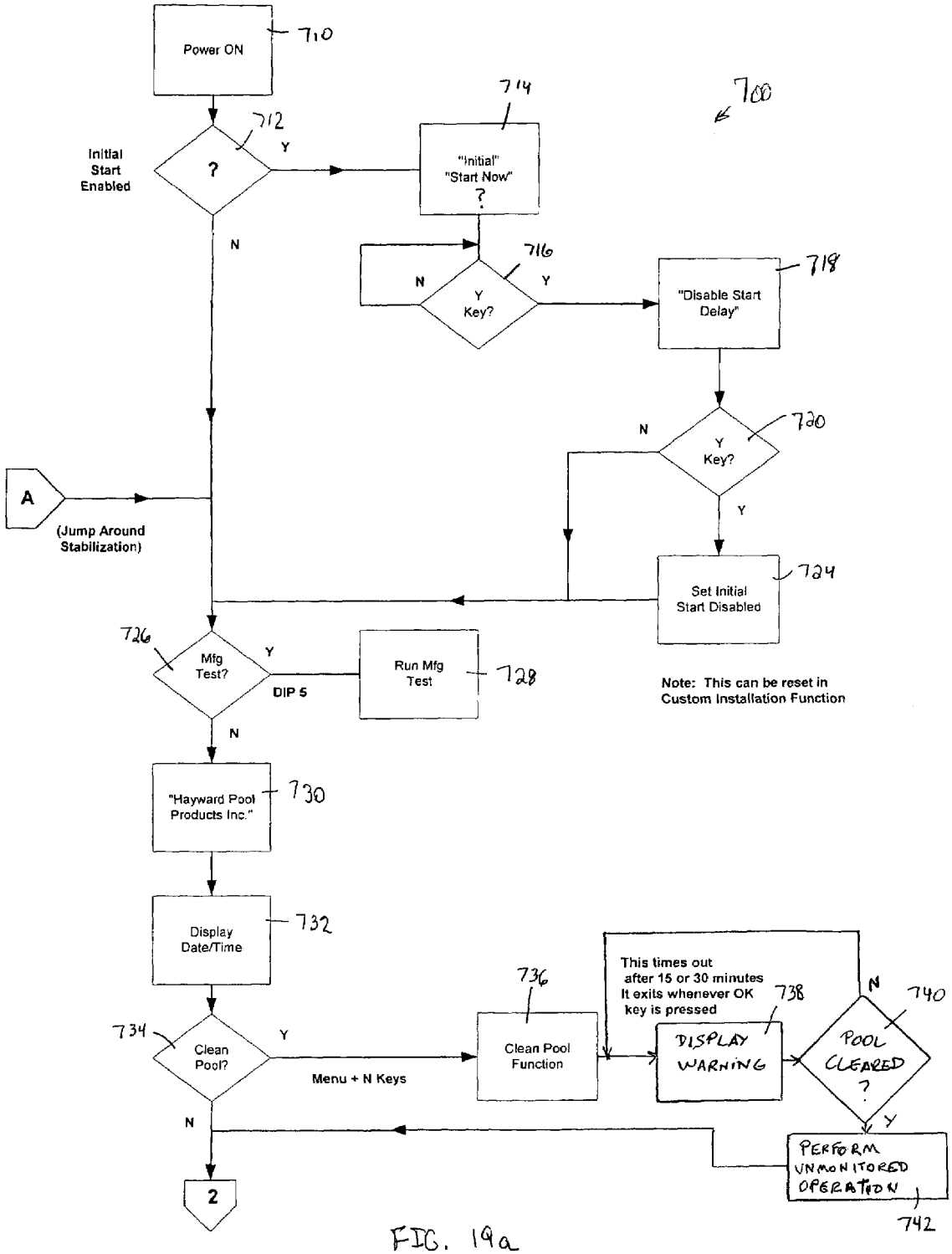
FIGS. 19*a*-19*f* are flowcharts illustrating functionality of an embodiment of the present invention.
Figure 19B:
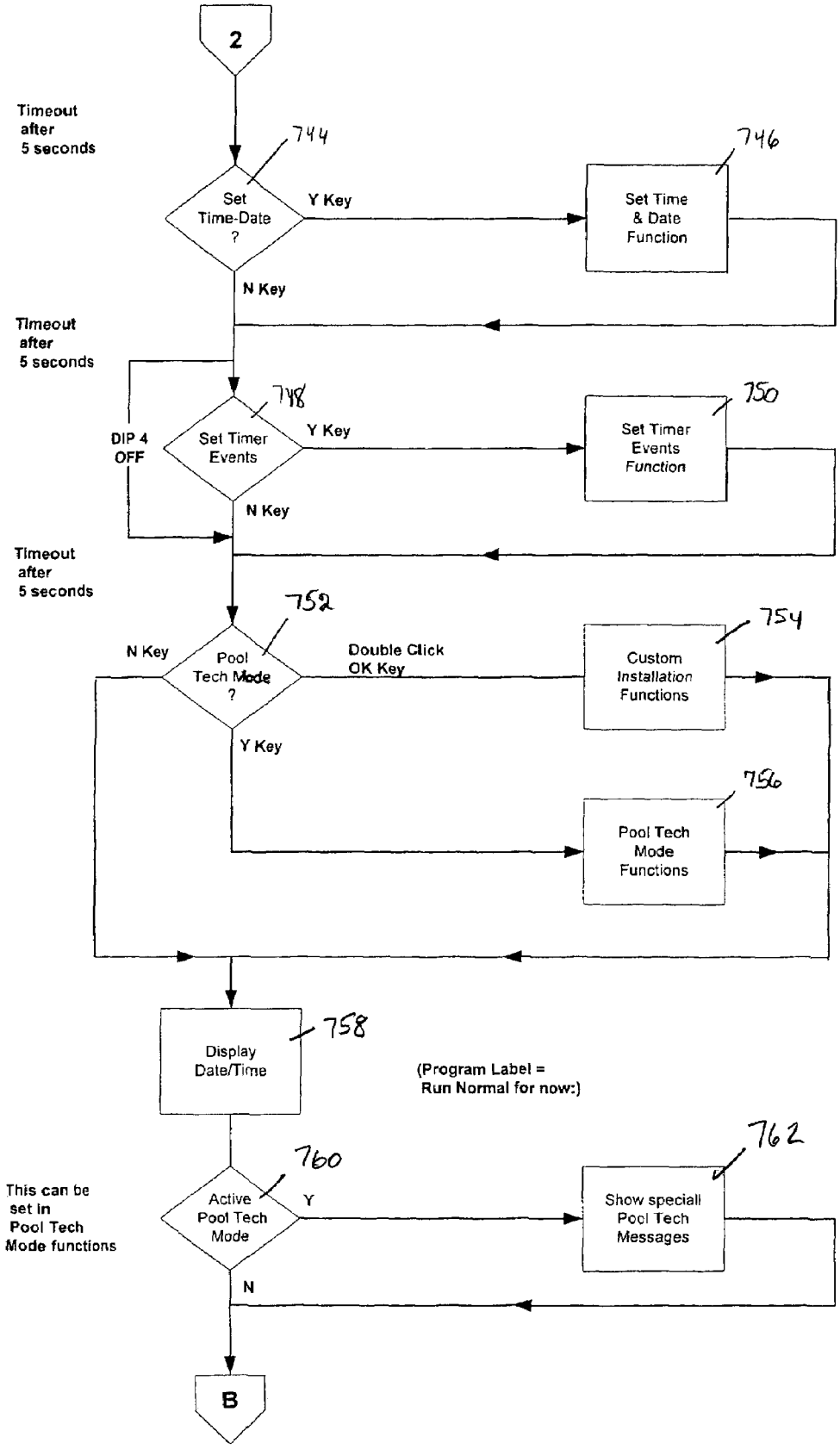

After the Timer Events query 748 and/or execution of the Set Timer Events Function 750, the controller checks to ascertain if the operator wishes to enter pool tech mode 752. This indication from the operator is not in response to a query posed by the controller, rather, the checking is done without messaging the operator via the display, e.g., 444. More particularly, if the operator, of his own incentive, wishes to enter Pool Tech Mode and is aware of the combination of key depressions that are required, then Pool Tech Mode may be so indicated. It should be appreciated that any improbable combination of key depressions may be used as a secret code to invoke certain functions and that the secret code can be shared with a limited number of qualified persons to prevent unqualified persons from accessing certain functions that could otherwise be conducted. In FIG. 19*b*, the combination of key depressions is to double click the "OK" key. Of course, other combinations could readily be employed for this access "code". If Pool Tech Mode is successfully invoked, the Custom Installation Functions 754 and the Pool Tech Mode Functions 756 can be then be selected and performed. Custom Installation Functions would typically be conducted on initial installation of the system 400, however could be invoked later to reinstall the system or to make modifications to the original settings. Pool Tech Mode would include observing the measured vacuum sensed while the pool/spa is running in various modes, e.g., on start-up (while priming), while filtering, when running on high and low pump speed settings, when the booster pump is running and when cleaning (vacuuming the pool/spa). This gives the technician the opportunity to observe the actual vacuum levels actually realized during normal operation in these modes. The technician is then given the opportunity to change the high vacuum setting, i.e., the setting that will trigger shutdown. The system 400 preferably is initialized to have a default high vacuum setting , e.g., 12" Hg. If the pool/spa is operated in a mode typically having the highest vacuum levels, then the high setting can be assessed against actual levels encountered in this mode of running. For example, many pools experience high vacuum levels when the suction outlets are partially closed and a suction pump is in the skimmer. Based upon the actual vacuum readings, the high vacuum (fault trigger) setting can be adjusted upwards, e.g., in increments of 1" Hg. The maximum setting should never exceed 3" Hg. above the vacuum level needed to run the pool cleaner/vacuum. Another, alternative method for establishing the high vacuum limit, is to set the vacuum at a very high level, e.g., 20" Hg. to permit operation and then to reduce the level to 3" Hg. above the empirical vacuum level experienced when the pool is running in a stabilized condition.

Another Custom Installation function is to zero the vacuum sensor. The sensor is initialized to zero at the factory and therefore reflects a zero value for the specific atmospheric pressure at the factory. In the event the system 400 is installed at a significantly different elevation, then the difference in atmospheric pressure may result in pressure effects attributable thereto rather than directly attributable to operation in a pool spa system. Accordingly, the present invention permits re-zeroing the vacuum sensor. The power supply voltage level (115/208/230 VAC) may also be set.

Because the time required for priming the pump will vary for the particular installation, e.g., due to the length of the suction conduit 424 and/or the other lines leading from the drains and the elevation of the pump relative to the water level, the controller 410 during Custom Installation Functions 754 permits the amount of time allocated to achieve prime to be adjusted during the custom install procedure. In addition to adjusting the time allotted to prime the pump before indicating an error condition, the threshold vacuum value used to ascertain if priming is occurring without a critical defect in the lines (break in the line which admits air or other water/air leak, such as an improperly installed strainer lid, that would lead to dry running of the pump) may also be adjusted. Once again, because the vacuum levels experienced during priming will vary for specific installations, normal priming vacuum levels for one installation may be significantly higher or lower than for other installations, hence the threshold indicating critical failure needs to be adjusted up or down based upon empirical values observed by the technician. The default vacuum threshold for priming is initially set to 30% of the vacuum level observed during stabilized operation of the circulation system. Unless the particular installation experiences difficulty in priming, the 30% default value should not be changed.

Given that the vacuum conditions during stable running will change depending upon changing conditions within the filter (as the filter accumulates dirt, it will present more resistance to the filtration flow resulting in lower vacuum values.) A stable running low threshold is therefore useful to provide a window of operability without indicating an error condition that triggers shutdown of the circulation system. As noted above, in addition to monitoring for high vacuum conditions indicating blockage of a drain, the controller 410 also monitors for low vacuum conditions which could indicate a line break such that the pump(s) may be protected from run-dry conditions by depowering the pump. This low vacuum monitoring uses values appropriate to the stage of operation that the system is in, e.g., priming or stable running. In stable running, the low vacuum threshold is set by default at 60% of the normal, unimpeded stable running vacuum level. As noted above, because each pool/spa installation will vary, e.g., in the type of filter employed, i.e., DE, sand, cartridge, the size of the filter, the amount of debris loading due to environmental effects, the stable running low threshold may need to be adjusted. This can be done as part of the Custom Install Functions 754 based upon the vacuum levels noted empirically (by the installation technician or a trouble shooter who has come to resolve the frequent shut-down of the system).

When the system is first installed and the pump is run, the controller, e.g., 410 recognizes when the pump 412 achieves a stable condition and records the vacuum level associated with that stable run condition. In the event that the first recorded stable run vacuum level was not representative of the actual stable running, e.g., due to an anomaly, such as an air leak due to an improperly installed strainer basket lid, then the Custom Installation Functions permit the technician to reset the stable vacuum level after the correction of the condition leading to the anomaly.

If the operator pressed "Y" in response to query 752, then the Pool Tech Mode Functions 756 are enabled. The time and date are displayed 758. If Pool Tech Mode was selected at decision 752 and the controller 410 is in Active Pool Tech Mode 760, the Pool Tech Mode functions are presented to the operator via specific messages 762. These messages and functions would include a query to the operator as to whether a two-speed pump is installed and if so, to double check that the dip switch settings are appropriate for a two speed pump. The operator is then queried if the drain cover(s) are installed. If not, the system must be powered down before it will restart. If the drain cover(s) are installed, the operator is queried as to whether he/she would like to manipulate the data log, which is a log of all events retained in the memory of the controller. The event log can be used by the technician to identify and correct problems in the system. After completing the desired Custom Installation Functions and/or the Pool Tech Mode Functions, such as setting the high vacuum level, the operator may terminate Pool Tech mode by pressing "OK/MENU".

Figure 19C:
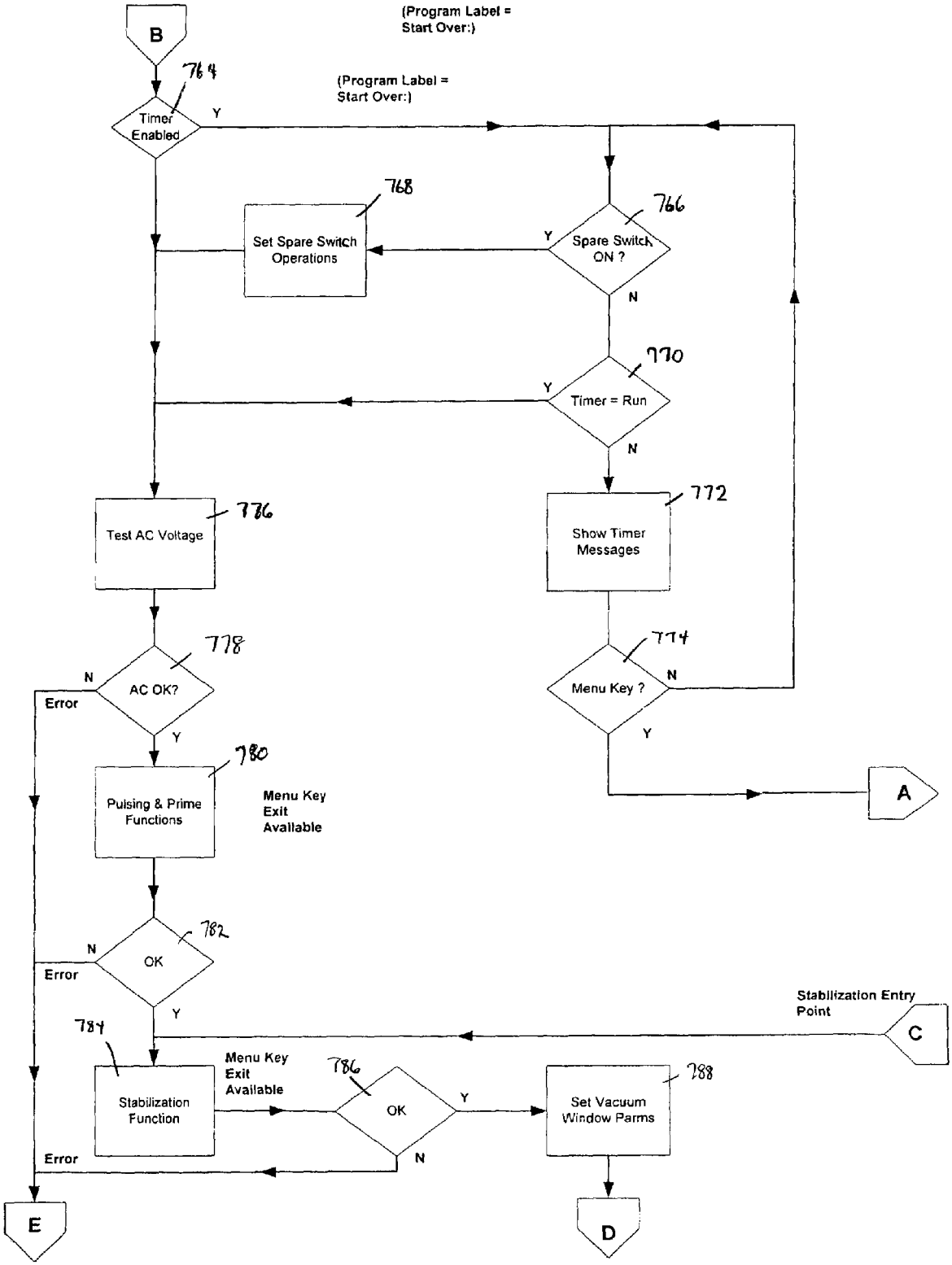
Figure 19D:
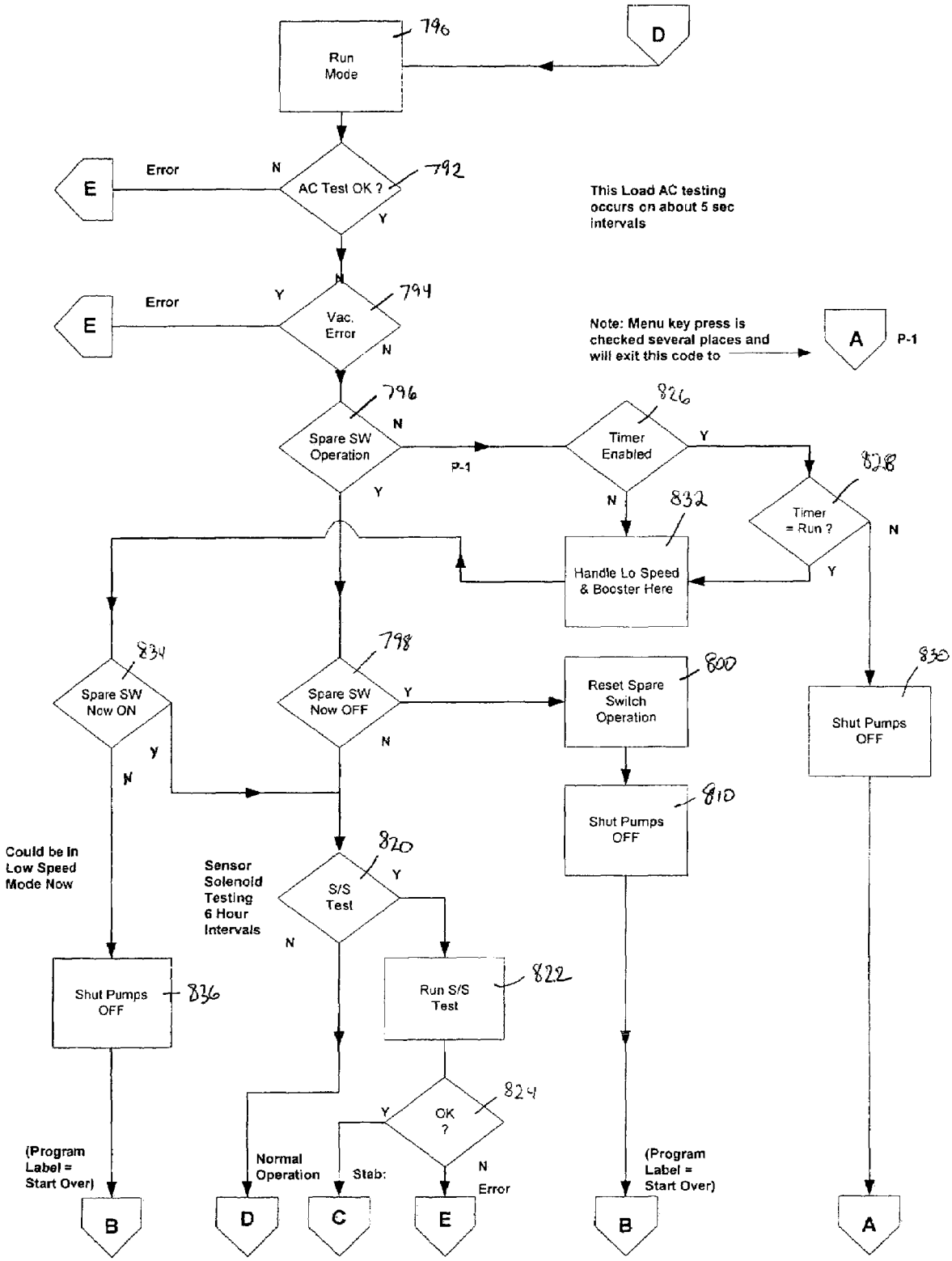

On FIG. 19*c*, the processing continues with an internal check 764 to ascertain if the timer has been enabled. If so, the program checks 766 to see if a spare switch is ON. A spare switch is a physical switch that the pool/spa owner or a technician can use to turn a pump associated therewith ON (overriding the OFF state otherwise established by the controller 410, e.g., pursuant to a schedule/timed event). Preferably, the spare switch is a logical switch which is connected to the microprocessor of the controller 410., rather than a power switch which directly controls power to the relevant pump. If the Spare Switch Is ON, then the microprocessor is instructed to Set Spare Switch Operations 768, e.g., turn the filter pump and/or the booster pump ON in order to clean the pool.

If the test 766 is Negative, then the controller 410 checks 770 if the timer indicates a RUN condition/If not, messages pertaining to time scheduled events are displayed 772, such as, identifying the next timed event and when it is to occur, as well as indicating to the operator that they may press MENU for other options. The controller 410 monitors if MENU has been pressed 774. If so, control returns to connection point "A" on FIG. 19*a*. If MENU is not pressed, control loops back through decision 766 until the spare switch is turned ON, the timer indicates RUN or the MENU key is pressed.

When the timer indicates RUN at decision 770, an AC Voltage test is conducted 776 wherein the controller 410 ascertains whether the voltage level is within an operable range, i.e., not too high due to a surge or too low due to a brown-out or other power interruption. If the voltage is out of range as tested at decision 778, control passes to connection point "E" on FIG. 19*e*. If the voltage is within range, the controller proceeds to the Pulsing and Priming Functions 780, i.e., to start the filtration pump 412. On startup, the vacuum solenoid valve 458 is opened and closed several times to "soft start" the system and to warn swimmers that the pump 412 has started. A self-test may be conducted at this time to verify that the vacuum sensor 435 and solenoid valve 458 are functioning properly. More particularly, when the pump, e.g., 412 is cycled ON/OFF, there should be corresponding changes in vacuum levels due the opening of the vacuum solenoid valve 458, which should be sensed by the vacuum sensor 435. During start-up, the controller continually tests 782 to verify that the high vacuum limit is not exceeded, which would indicate a malfunction, such as the occlusion of a drain, thus protecting swimmers from becoming trapped on a drain. A low vacuum threshold is also optionally tested at this time, as set at step 754, to prevent the pump from running in a dry state.

If no errors are encountered, the Stabilization Function 784 is performed. While the pump 412 is running, the vacuum sensor 435 continually monitors the vacuum level reporting it to the controller 410 and the controller 410 continually verifies 786 that the High Vacuum Limit is not exceeded. As the pump 412 becomes fully primed, the vacuum experienced by the vacuum sensor 435 should stabilize. This stabilization allows Vacuum Window Parameters to be set 788. The Vacuum Window is a tolerance range of vacuum variation centered around the actual experienced vacuum level empirically determined at stabilization. Given this empirical value, the vacuum window may then be set to be in a range (+/−) of this actual reading (average reading), e.g., +/− 3" Hg. As a result, the Vacuum window is a tighter range of acceptable vacuum levels than that between the High and Low Vacuum Limits and is centered on the actual operating vacuum levels present in the running pool/spa system after stabilization.

Having established the Vacuum Window Parameters 788, the controller 410 then executes Run Mode 790. When the system is in Run Mode 790, vacuum measurements are taken at about 1000 samples per second and averaged, yielding a test vacuum value every hundredth of a second. This average value may then be compared 794 to the vacuum window calculated in step 788 to determine if it is within an acceptable range. If not, vacuum anomaly processing is conducted (connector "E"). Besides monitoring vacuum levels, the power input voltage is also monitored 792 to ascertain if it remains in an acceptable range. If not, error processing is conducted (see connector "E").

The operation of the spare switch, e.g., 431 (if applicable) is also monitored. In the event that a spare switch 431 has been operated (decision 796), the state of the spare switch is tested 798, i.e., to see if it is presently OFF. If the spare switch is OFF, the controller records that state (Reset Spare Switch Operation 800) and turns the pump(s) controlled by the spare switch OFF 810. In the event that the spare switch is ON, the controller 410 continues to run the pump(s) effected. The controller 410 checks a time count 820 to determine if it is time to conduct a vacuum sensor and solenoid test. Periodically, e.g., every 6 hours, the vacuum sensor 435 and solenoid valve 458 are tested 822, i.e., by exercising them through a variation in pumping, e.g., by cycling the vacuum solenoid valve 458 and/or the pump 412 to ascertain that the vacuum changes and is sensed. For example, if during pulsing (step 780), if a difference of at least ½" Hg. between the highest and lowest measured vacuum levels is not detected, then the sensor/solenoid test is failed. If the vacuum solenoid valve 458 and vacuum sensor 435 pass the test, then processing continues at connector "C", otherwise error processing proceeds at connector "E".

For embodiments of the present invention utilizing a vacuum conduit, such as 430 that extends to the controller 410 and to a vacuum sensor 435 therein, the present invention preferably includes a vacuum monitoring function that verifies that the vacuum conduit 430 is not plugged with debris or kinked and therefore obscuring the actual state of vacuum present in the suction conduit 424. More particularly, vacuum levels established in vacuum conduit 430 and vacuum tube 462 are sensed by vacuum sensor 435. These levels change depending upon the state of the pump 412, the obstruction of drains, e.g., 112, etc. In addition, there are small fluctuations in the vacuum level that are present even after stabilization. If the vacuum conduit becomes obstructed, e.g., plugged with debris or kinked, then the portion of the vacuum conduit 430 between the obstruction and the vacuum sensor 435 becomes sealed/isolated from the vacuum levels present in the suction conduit 424. As a result, the sealed/isolated portion of the vacuum conduit 430 will retain the vacuum level that was present therein when the obstruction occurred and therefore the sensor will therefore not be effective in detecting changing vacuum conditions in the suction conduit 424. Of course, this type of occlusion would frustrate the operation and purpose of the vacuum release system 400.

In order to detect and prevent any negative consequences from vacuum conduit 430 occlusion, the present invention monitors the vacuum level for a sustained, unchanging vacuum level, i.e., a static vacuum level, which would be indicative of vacuum conduit 430 occlusion. A static or constant vacuum level would be indicative of occlusion because even in stabilized running, there is a constant fluctuation in vacuum level during normal operation. The present invention therefore compares the vacuum level taken at successive intervals and ascertains if there is an abnormal constancy. If the vacuum level appears static, then the vent valve 458 is triggered exposing the vacuum conduit 430 to atmospheric pressure or to the pressure developed in the accumulator 537. In addition, the pump 412 may be cycled ON/OFF. These action(s) are intended to purge the vacuum conduit 430 of clogs. Upon sensing abnormal constancy in the vacuum conduit 430 and triggering the vacuum reduction response, the error event is recorded. The system 400 then resets the vent valve 458 to a non-venting position and/or restarts the pump 412. Vacuum level is rechecked to ascertain normal fluctuations in vacuum. If the vacuum remains constant, then the vent valve 458 is again placed in a venting position, the pump 412 is shut down and an error message displayed indicating that the vacuum conduit 430 is blocked. The system 400 then requires overt operator intervention to restart, such as by answering queries concerning the state of the vacuum conduit 430.

If, at decision 796 there has been no spare switch operation, then the controller checks 826 to see if the Timer is Enabled. If so, a check 828 is made as to whether the timer indicates that the pump(s) should be running. If not, the pump(s) are shut OFF 830. In the event that the timer is set to RUN, then the effected pump(s) are either turned ON or left ON, as applicable 832. Thereafter, the state of the Spare Switch is checked 834 to see if it is ON. If ON, the effected pumps are left running and the processing continues at decision block 820, otherwise, the effects pump(s) are shut OFF 836.

Figure 19E:
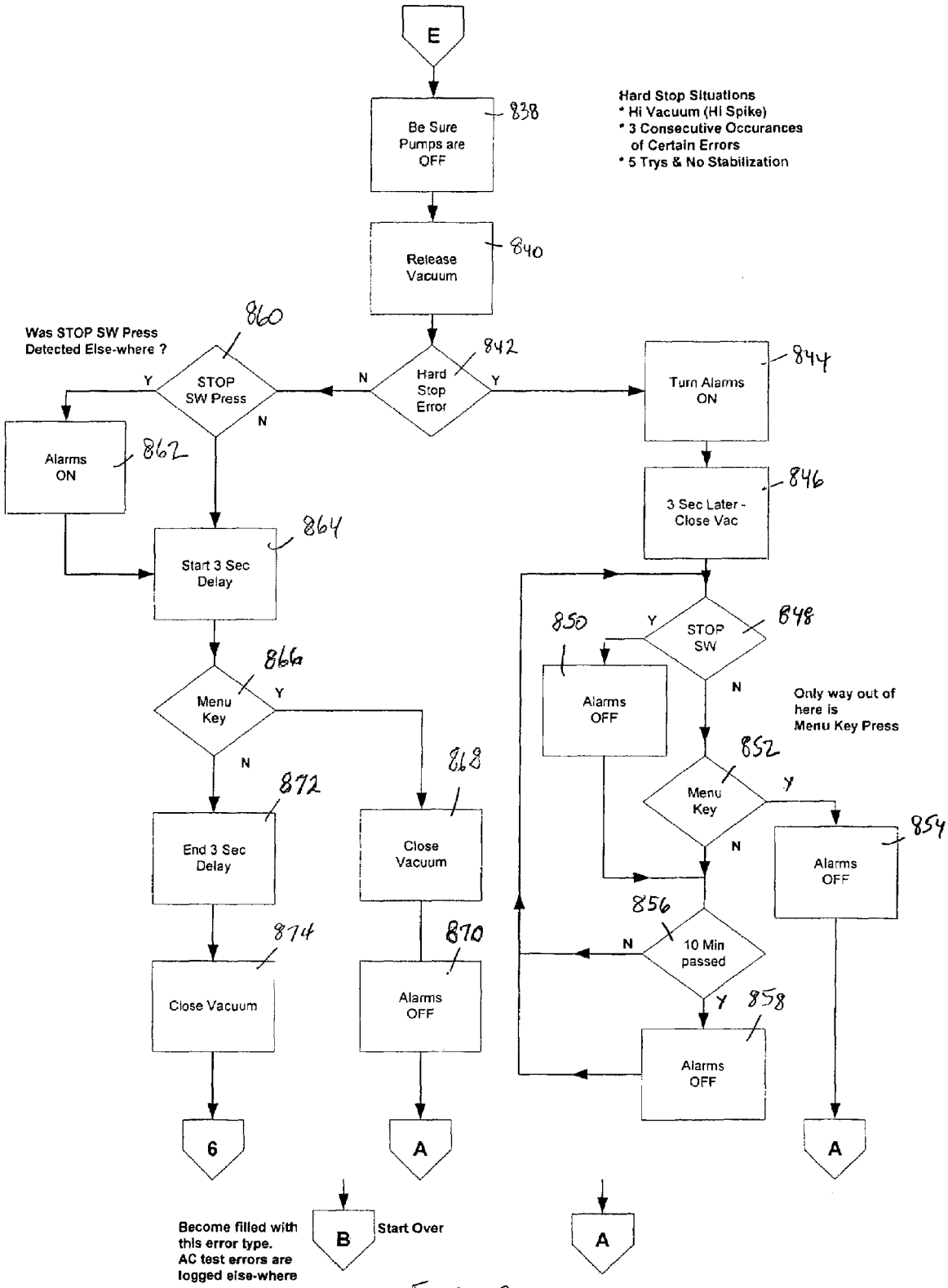
Figure 19F:
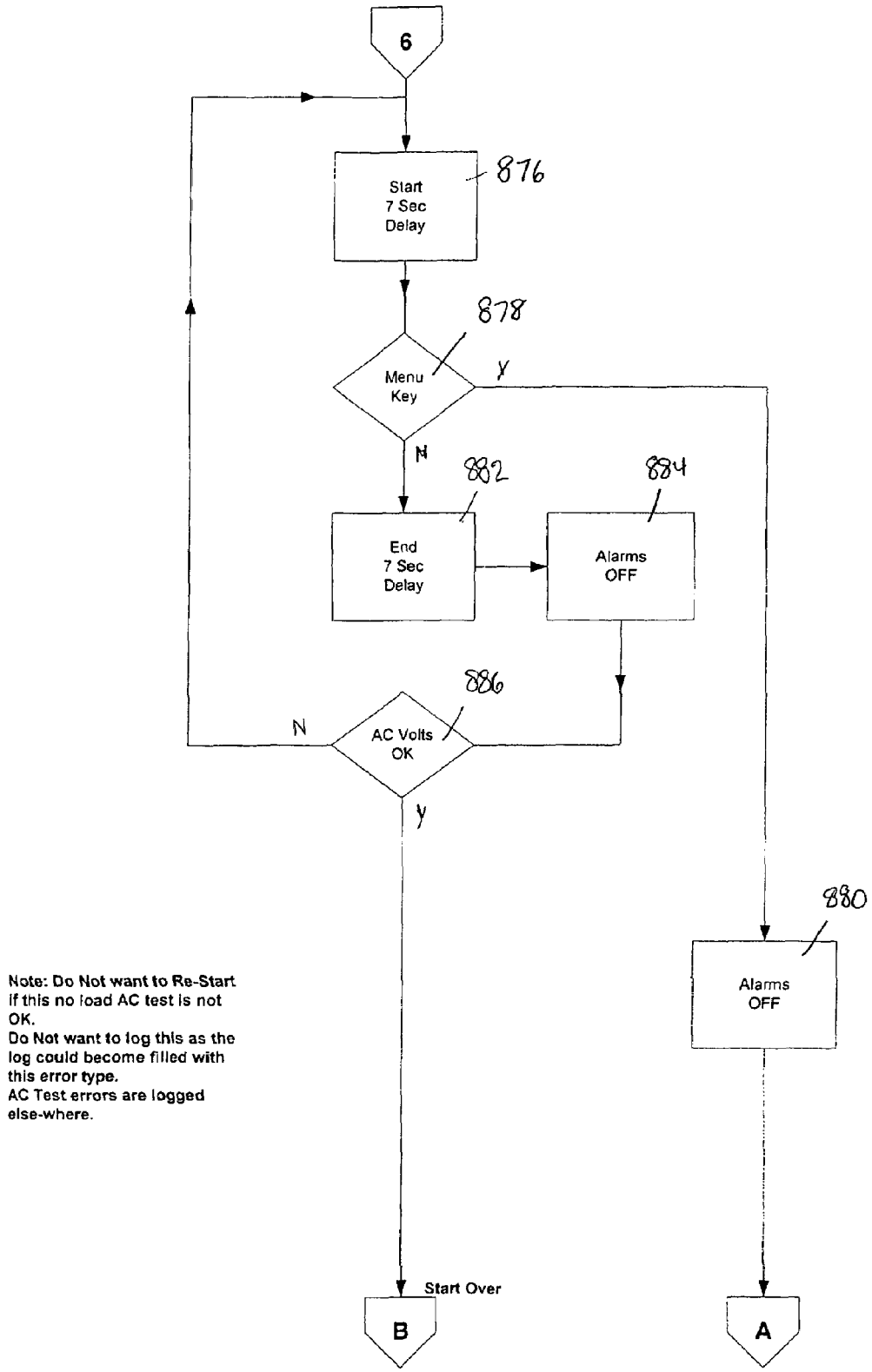

FIG. 19*e* depicts error processing, the first step of which is to verify 838 that all pumps are turned OFF, followed by releasing 840 the vacuum in the suction conduit 424, i.e., by repositioning the vacuum solenoid valve 458 to expose the suction conduit 424 to atmosphere or to the pressurized fluid in the accumulator 537, as applicable. The controller 410 then checks 842 to see if the error is a Hard Stop Error. If so, the alarm(s), e.g., 427 are turned ON 844. After three seconds, the vacuum solenoid valve 458 is repositioned 846 to prevent further venting of the suction conduit 424 and/or exposure of the suction conduit 424 to pressurized fluid from the accumulator 537. The controller then checks 848 to see if the Hard Stop was due to the depression of the Stop Switch 429 (Panic button). If so, the alarm(s) are turned OFF 850. If the Stop Switch 429 was not pressed, the controller 410 ascertains 852 if the Menu Key has been depressed. If so, the Alarm(s) are turned OFF 854. If not, the controller 410 pauses for a predetermined time, e.g., ten minutes, during which time the alarm(s), e.g., 427 are sounding. At the end of the pause, the alarm(s) are turned OFF 858.

Returning to decision 842, if the error was not a Hard Stop Error, the controller 410 verifies 860 that the Stop Switch 429 has not been pushed. If it has, the alarm(s), e.g., 427 are turned ON 862 and then there is a predetermined delay period 864, e.g. three seconds, during which time venting to atmosphere/reverse flow from the accumulator 537 is occurring to reduce the vacuum level at the drains, e.g., 12, 14 (FIG. 1). The controller 410 then checks 866 to determine if the Menu Key has been pressed. If so, the vacuum solenoid valve is repositioned 868 to stop venting/reverse flow and the Alarm(s) are turned OFF 870. In the event that check 866 indicates that the Menu Key was not depressed, then the delay is ended 872 and the vacuum solenoid valve is repositioned 874 to stop venting/reverse flow. Processing continues via connector "6" on FIG. 19*f*, viz., there is a delay 876, e.g., for seven seconds. During the delay, controller 410 monitors 878 whether the Menu Key is pressed. If so, the Alarm(s) are turned OFF 880 and processing resumes via Connector "A" on FIG. 19*a*. If the Menu Key is not pressed, the entire delay is counted down to the end 882, at which time, the Alarm(s) are turned OFF. The controller 410 then checks 886 then AC voltage level. If the voltage level is O.K., then processing continues via connector "B" on FIG. 19*c*. Otherwise, processing returns to Connector "6".

Besides the various queries that are described above, the controller 410 also displays informational messages pertaining to the operational state of the system, error messages, etc., such as: "Calibrating", "Starting Pump", "Stabilizing", "Monitoring", "Stop Switch" (If the Stop Switch is depressed it needs to be reset before the system will resume operation.), "S/S Vent Error" (Sensor/Solenoid Venting error—This may occur due to the clogging of the vent 432), "No Stabilization", "Self Test", "Over Window Vacuum", "Under Window Vacuum", "High Vacuum Alert", "System Won't Stabilize", "Too Many Sensor Solenoid Errors or No Prime", etc.

In responding to vacuum anomalies characteristic of drain occlusion, the present invention provides for vacuum reduction via venting or reverse pressurized flow in conjunction with pump shut down. The present invention recognizes that it may be preferable in many pool/spa installations for the venting and/or reverse flow to be limited to a relatively short time period, e.g., three seconds. This brief time period is adequate to reduce vacuum at any drain to allow a swimmer to escape drain entrapment. Because the present invention contemplates use of a narrow window of acceptable vacuum levels to provide an enhanced sensitivity to vacuum changes, it is more likely to interpret vacuum levels outside the acceptable window as errors and therefore trigger vacuum reduction and pump shutdown. Due to this enhanced sensitivity, the present invention provides adequate vacuum reduction to allow a swimmer's escape, but without losing the pump's prime and/or interrupting filtration media stability through the introduction of air into the filter system, e.g., 34. After exceeding a predetermined number of vacuum releases and restarts, the system requires operator intervention, e.g., by interacting with the controller 410, e.g., by answering questions posed by the controller, which would indicate the pool spa system is safe to use before the controller 410 will allow restarting. Furthermore, the controller 48, 148, 410, 510 of the present invention provides for a selected number of automatic restarts under circumstances which are due to transient non-threatening vacuum variations.

It should be understood that the embodiments described herein are merely exemplary and that a person skilled in the art may make many variations and modifications without departing from the spirit and scope of the invention. For example, the present invention has been described above in reference to swimming pools and spas, but could be applied to fountains, water features, water park areas, or other installations where water is pumped into a receptacle and is subsequently drained there from. All such variations and modifications are intended to be included within the scope of the present invention.

What is claimed is:

1. A method for controlling a fluid containment and circulation system having a fluid receptacle with a fluid outlet through which fluid exits the receptacle, a fluid inlet for returning fluid to the receptacle, a pump that moves the fluid from the fluid outlet through a filter to the fluid inlet, a suction conduit providing fluid communication between the fluid outlet and the pump and a return conduit providing fluid communication between the pump and the fluid inlet, a vacuum sensor for sensing a level of vacuum present in the suction conduit and producing a corresponding output, a vent valve having at least two positions, a first position which fluidly connects the suction conduit to matter outside the suction conduit and a second position which isolates the suction conduit from matter outside the suction conduit and a programmed computer, comprising the steps of:

(A) storing at least one vacuum criteria and an operator-determined pump schedule in said computer;

(B) receiving the output of said vacuum sensor in said computer;

(C) comparing the vacuum sensor output to the at least one vacuum criteria;

(D) selectively generating control outputs to said vent valve as determined by the computer to determine the position of said vent valve and to control the operation of the pump, based upon said vacuum sensor output;

(E) periodically checking the time and comparing it to the pump schedule to determine an operator-determined operational state of the pump for that time and controlling the operational state of the pump accordingly, the pump having a plurality of running speeds for passing the fluid through the filter at a plurality of different rates, the operational state of the pump including the speed at which the pump runs, said at least one vacuum criteria having a plurality of values, a first corresponding to a first running speed of the pump and a second corresponding to a second running speed of the pump.

2. The method of claim 1, wherein the at least one vacuum criteria includes a high vacuum limit and wherein said step (D) further comprises:

positioning the vent valve to the first position when the result of comparing the vacuum sensor output to the high vacuum limit indicates that the high vacuum limit has been violated; and turning the pump OFF when the high vacuum limit has been violated.

3. The method of claim 2, wherein the at least one vacuum criteria includes a low vacuum limit and further comprising the step of turning the pump OFF when the low vacuum limit has been violated.

4. The method of claim 3, wherein said at least one vacuum criteria includes a vacuum range between a relative high limit and a relative low limit, and further comprising the step of calculating the vacuum range relative to an empirically measured vacuum level.

5. The method of claim 4, wherein each of said high vacuum limit, said low vacuum limit and said vacuum range have a plurality of values, corresponding to a plurality of modes of operation of the fluid containment and circulation system.

6. The method of claim 4, wherein the modes of operation of the fluid containment and circulation system include pump priming mode, stabilized mode, and cleaning mode.

7. The method of claim 6, wherein the plurality of values are calculated relative to empirical vacuum levels measured during the operation of the fluid containment and circulation system in the plurality of operational modes.

8. The method of claim 2, if said steps (C) and (D) result in positioning the vent valve in the first position and turning the pump OFF, further comprising the steps of (F) waiting a predetermined period;

(G) positioning the vent valve to the second position; and (H) restarting the pump.

9. The method of claim 8, further comprising the steps of automatically repeating steps (F) through (H) a predetermined plurality of times.

10. The method of claim 9, further comprising the steps of shutting the pump OFF for an indeterminate period following said step of repeating the predetermined plurality of times and requiring overt operator input to restart the pump.

11. The method of claim 1, further comprising the step of saving a log of violations of the vacuum criteria in computer readable media.

12. The method of claim 11, further comprising the step of saving a record of operational states and operator inputs in the log.

13. The method of claim 1, wherein said at least one predetermined vacuum criteria includes a rate of change of the vacuum level.

14. The method of claim 1, wherein the fluid containment and circulation system includes an emergency stop switch and further including the steps of monitoring the state of the emergency stop switch and, in the event that the emergency stop switch is pressed, placing the vent valve in the first position and shutting the pump OFF.

15. The method of claim 14, further including the step of activating a sensory alarm when the emergency stop switch is pressed.

16. A method for controlling a fluid containment and circulation system having a fluid receptacle with a fluid outlet through which fluid exits the receptacle, a fluid inlet for returning fluid to the receptacle, a pump that moves the fluid from the fluid outlet to the fluid inlet, a suction conduit providing fluid communication between the fluid outlet and the pump and a return conduit providing fluid communication between the pump and the fluid inlet, a vacuum sensor for sensing a level of vacuum present in the suction conduit and producing a corresponding output, a vent valve having at least two positions, a first position which fluidly connects the suction conduit to matter outside the suction conduit and a second position which isolates the suction conduit from matter outside the suction conduit and a programmed computer, comprising the steps of:

(A) storing at least one vacuum criteria in said computer;

(B) receiving the output of said vacuum sensor in said computer;

(C) comparing the vacuum sensor output to the at least one vacuum criteria; and (D) selectively generating control outputs to said vent valve as determined by the computer to determine the position of said vent valve and to control the operation of the pump, based upon said step (C) of comparing the vacuum sensor output to the at least one vacuum criteria; (E) periodically varying the vent valve position by generating test control outputs to said vent valve independently of said steps (C) of comparing and (D) of selectively generating; and (F) monitoring the vacuum level in response to said step (E) of periodically varying to test the operability of the vacuum sensor and the vent valve by verifying that said step (E) of periodically varying results in a change in vacuum sensor output.

17. The method of claim 1, wherein the fluid containment and circulation system includes a booster pump and wherein the operational state of the booster pump is determined by the operator-determined pump schedule.

18. The method of claim 1, wherein the fluid containment and circulation system includes an override switch by which the operator can control the operational state of the pump independently of the operational state indicated by the operator-determined pump schedule to place it ON when it is scheduled to be OFF.

19. The method of claim 1, wherein the fluid level in the fluid receptacle is at a higher elevation than the pump, and further comprising the step of injecting a pressurized fluid through the vent valve when the valve is in the first position.

20. The method of claim 19, wherein the fluid containment and circulation system includes an accumulator for storing fluid under pressure and wherein said step of injecting includes discharging the fluid stored under pressure in the accumulator.

21. The method of claim 20 wherein the fluid containment and circulation system has a fluid connection between the return conduit and the accumulator with a check valve therein and further comprising the steps of passing fluid pressurized by pressure in the return conduit through the check valve into the accumulator and preventing reverse flow through the check valve.

22. The method of claim 1, further including a step of cycling the vent valve from the second position to the first position and back to the second position at least once when the pump is started.

23. The method of claim 22, wherein said step of cycling includes a plurality of transitions between the second and first positions of the vent valve.

24. The method of claim 4, wherein the relative high limit is lower than the high limit and the relative low limit is greater than the low limit.

25. A method for controlling a fluid containment and circulation system having a fluid receptacle with a fluid outlet through which fluid exits the receptacle, a fluid inlet for returning fluid to the receptacle, a pump that moves the fluid from the fluid outlet to the fluid inlet, a suction conduit providing fluid communication between the fluid outlet and the pump and a return conduit providing fluid communication between the pump and the fluid inlet, a vacuum sensor for sensing a level of vacuum present in the suction conduit and producing a corresponding output, a vent valve having at least two positions, a first position which fluidly connects the suction conduit to matter outside the suction conduit and a second position which isolates the suction conduit from matter outside the suction conduit and a programmed computer, comprising the steps of:

(A) storing at least one vacuum criteria in said computer;

(B) receiving the output of said vacuum sensor in said computer;

(C) comparing the vacuum sensor output to the at least one vacuum criteria;

(D) selectively generating control outputs to said vent valve as determined by the computer to determine the position of said vent valve and to control the operation of the pump, based upon said vacuum sensor output, wherein the at least one vacuum criteria includes the constancy of the vacuum level; and (E) positioning the vent valve to the first position when the result of comparing a plurality of vacuum readings taken at different times indicates that the vacuum is constant in an operating mode typified by a varying vacuum level indicating an inoperable vacuum sensor.

26. The method of claim 25, further comprising the step of turning the pump OFF.

27. The method of claim 25, further comprising the step of repositioning the vent valve to the second position and subsequently checking the vacuum level to ascertain that it fluctuates in a normal manner, otherwise terminating pump operation and placing the vent valve in the first position.

28. The method of claim 16, further comprising the steps of (G) periodically varying the operational state of the pump by generating test control outputs to the pump independently of said steps (C) of comparing and (D) of selectively generating; and (H) monitoring the vacuum level in response to said step (G) of periodically varying to test the operability of the vacuum sensor and the pump by verifying that said step (G) of periodically varying results in a change in vacuum sensor output.

29. The method of claim 25, wherein the inoperability of the vacuum sensor is due to an occlusion of a fluid line communicating between the suction conduit and the vacuum sensor.

30. The method of claim 29, wherein said step (E) of positioning the vent valve to the first position removes the occlusion from the fluid line.

* * * * *